US007233217B2

(12) United States Patent
Phillips et al.

(10) Patent No.: US 7,233,217 B2
(45) Date of Patent: Jun. 19, 2007

(54) MICROSTRIP PHASE SHIFTER

(75) Inventors: Sara Phillips, Alpharetta, GA (US); Jacob Alaburda, Marietta, GA (US); Douglas E. Dawson, Glendale, CA (US)

(73) Assignee: Andrew Corporation, Westchester, IL (US)

( * ) Notice: Subject to any disclaimer, the term of this patent is extended or adjusted under 35 U.S.C. 154(b) by 346 days.

(21) Appl. No.: 10/226,641

(22) Filed: Aug. 23, 2002

(65) Prior Publication Data

US 2003/0076198 A1 Apr. 24, 2003

Related U.S. Application Data

(60) Provisional application No. 60/314,507, filed on Aug. 23, 2001.

(51) Int. Cl.
*H01P 3/08* (2006.01)

(52) U.S. Cl. ..... 333/116; 333/161

(58) Field of Classification Search ..... 333/116, 333/156, 161, 230–235, 246, 248, 139, 164
See application file for complete search history.

(56) References Cited

U.S. PATENT DOCUMENTS

| | | | | |
|---|---|---|---|---|
| 3,656,179 | A | | 4/1972 | De Loach |
| 3,769,610 | A | | 10/1973 | Savarin et al. |
| 4,160,976 | A | | 7/1979 | Conroy |
| 4,348,676 | A | | 9/1982 | Tom |
| 4,485,362 | A | | 11/1984 | Campi et al. |
| 4,517,570 | A | | 5/1985 | Gray, Jr. |
| 4,602,227 | A | | 7/1986 | Clark et al. |
| 4,633,203 | A | * | 12/1986 | Nowak ..... 333/161 |
| 4,636,755 | A | | 1/1987 | Gibbs |
| 4,788,515 | A | | 11/1988 | Wong et al. |
| 4,814,775 | A | | 3/1989 | Raab et al. |

(Continued)

FOREIGN PATENT DOCUMENTS

| | | |
|---|---|---|
| EP | 1 239 534 | 9/2002 |

(Continued)

OTHER PUBLICATIONS

International Search Report dated Jan. 24, 2003 for PCT/US02/26766.

(Continued)

*Primary Examiner*—Linh V. Nguyen
(74) *Attorney, Agent, or Firm*—Michael J. Mehrman; Mehrman Law Office PC

(57) ABSTRACT

A phase shifter adjusts the phase between two segments of an RF feed line that are fed with the phase shifter. Specifically, the phase shifter adjusts the phase between two signals in RF feed line segments by changing the electrical path lengths that RF energy travels down in each respective RF feed line. The phase shifter includes a coupling arm, a key, a spring, and a support architecture that fastens the phase shifter to a substantially planar surface. The support architecture is rotated manually or with a machine such as a motor. The coupling arm can include a coupling ring, a wiper element, a support trace, and a dielectric spacer. The phase shifting system is a relatively compact structure having a predetermined value of capacitance maintained between a coupling ring disposed on the coupling arm and a coupling ring disposed on a planar surface.

32 Claims, 10 Drawing Sheets

U.S. PATENT DOCUMENTS

| | | | | |
|---|---|---|---|---|
| 5,075,648 | A | 12/1991 | Roberts et al. | |
| 5,162,803 | A | 11/1992 | Chen | |
| 5,210,542 | A | 5/1993 | Pett et al. | |
| 5,343,173 | A | 8/1994 | Balodis et al. | |
| 5,473,294 | A | 12/1995 | Mizzoni et al. | |
| 5,512,914 | A | 4/1996 | Hadzoglou et al. | |
| 5,523,764 | A | 6/1996 | Martinez et al. | |
| 5,563,558 | A | 10/1996 | Mohwinkel et al. | |
| 5,714,961 | A | 2/1998 | Kot et al. | |
| 5,798,675 | A | 8/1998 | Drach | |
| 5,798,734 | A | 8/1998 | Ohtsuka et al. | |
| 5,861,848 | A | 1/1999 | Iwasaki | |
| 5,917,455 | A * | 6/1999 | Huynh et al. | 343/792.5 |
| 5,940,030 | A | 8/1999 | Hampel et al. | |
| 5,949,303 | A | 9/1999 | Arvidsson et al. | |
| 5,949,370 | A | 9/1999 | Smith et al. | |
| 5,973,641 | A | 10/1999 | Smith et al. | |
| 5,995,047 | A | 11/1999 | Freyssinier et al. | |
| 6,005,522 | A | 12/1999 | Arias et al. | |
| 6,069,529 | A | 5/2000 | Evans | |
| 6,091,311 | A | 7/2000 | Waters | |
| 6,097,267 | A | 8/2000 | Hampel | |
| 6,118,379 | A | 9/2000 | Kodukula et al. | |
| 6,198,458 | B1 | 3/2001 | Heinz et al. | |
| 6,208,222 | B1 | 3/2001 | Sinsky | |
| 6,219,002 | B1 | 4/2001 | Lim | |
| 6,246,370 | B1 * | 6/2001 | Wixforth | 343/700 MS |
| 6,278,410 | B1 | 8/2001 | Soliman et al. | |
| 6,292,143 | B1 | 9/2001 | Romanofsky | |
| 6,333,683 | B1 | 12/2001 | Hampel | |
| 6,346,924 | B1 | 2/2002 | Heinz et al. | |
| 6,441,700 | B2 | 8/2002 | Xu | |
| 6,441,785 | B1 | 8/2002 | Rosen et al. | |
| 6,504,450 | B2 * | 1/2003 | Kim et al. | 333/156 |
| 6,573,875 | B2 | 6/2003 | Zimmerman et al. | |
| 6,586,931 | B2 * | 7/2003 | Taicher | 324/303 |
| 6,788,165 | B2 * | 9/2004 | Runyon | 333/117 |
| 6,850,130 | B1 * | 2/2005 | Gottl et al. | 333/161 |
| 6,870,512 | B2 * | 3/2005 | Yoneda et al. | 343/781 CA |
| 6,963,314 | B2 * | 11/2005 | Webb et al. | 343/844 |
| 2002/0070900 | A1 | 6/2002 | Phelan | |
| 2002/0089394 | A1 | 7/2002 | McDonald et al. | |
| 2002/0113750 | A1 | 8/2002 | Heinz et al. | |
| 2005/0046514 | A1 * | 3/2005 | Janoschka | 333/156 |
| 2005/0219133 | A1 * | 10/2005 | Elliot | 343/757 |

FOREIGN PATENT DOCUMENTS

| | | | |
|---|---|---|---|
| EP | 1 239 535 | | 9/2002 |
| EP | 1 239 538 | | 9/2002 |
| GB | 1 314 693 | | 4/1973 |
| GB | 2171864 | A | 2/1986 |
| JP | 62082801 | A | 4/1987 |
| JP | 01268209 | | 10/1989 |
| JP | 04000902 | | 1/1992 |
| JP | 05037222 | | 2/1993 |
| JP | 5-121915 | | 5/1993 |
| JP | 07183717 | | 12/1993 |
| JP | 06-326501 | | 11/1994 |
| JP | 8-102601 | | 4/1996 |
| JP | 09148801 | | 6/1997 |
| JP | 09214211 | | 8/1997 |
| JP | 09246845 | | 9/1997 |
| JP | 09246846 | | 9/1997 |
| JP | 10013103 | | 1/1998 |
| JP | 11-298212 | | 10/1999 |
| JP | 2000-196302 | A | 7/2000 |
| JP | 2001-196804 | | 7/2001 |
| JP | 2002-33603 | A | 2/2002 |
| WO | WO 95/10862 | | 4/1995 |
| WO | WO 96/14670 | | 5/1996 |
| WO | WO 01/13459 | | 2/2001 |
| WO | WO 02/05383 | | 1/2002 |

OTHER PUBLICATIONS

International Search Report dated Apr. 3, 2003 for PCT/US02/35983.

Mills, B.Y., Aitchison, R.E., Little, A.G. and McAdam, W.B.; "The Sydney University Cross-type Radio Telescope" *Proceedings of the I.R.E. Australia* (Feb. 1963).

* cited by examiner

MICROSTRIP PHASE SHIFTER

STATEMENT REGARDING RELATED APPLICATIONS

The present application claims priority to U.S. Provisional Application entitled "Microstrip Phase Shifter," filed on Aug. 23, 2001 and assigned U.S. application Ser. No. 60/314,507. The entire contents of the provisional application are hereby incorporated by reference.

FIELD OF INVENTION

The present invention relates to adjusting electrical phase of signals, and more specifically, to the phase adjustment of electrical signals as used in RF feed lines in wireless communication products, such as in antennas.

BACKGROUND OF THE INVENTION

Phase shifters are known for adjusting the phase of electrical signals in various kinds of products and systems. Phase shifters are especially useful in navigation, tracking and communication equipment to control characteristics of the associated electrical signals. Various types of phase shifters have been designed for particular uses, but while useful in particular environments, the disadvantages of many phase shifter designs have limited their use in the field of multi-carrier, high power antennas, such as base station antennas as used in the mobile communications industry.

One conventional technique is the line-stretcher phase shifter which uses a coaxial transmission line that is extendable in a telescope-type fashion. This technique usually requires rather complex sliding-contacts and can be very sensitive to corrosion. Another conventional technique is a phase shifter that is adjusted mechanically by sliding an external sleeve along the body of the phase shifter so to alter the relative phase of the signals at the phase shifter's outputs. A drawback of this type phase shifter that employs moveable or sliding contacts is that it is susceptible to generating adverse Passive Intermodulation (PIM) that occurs especially when high power and multi-carrier electromagnetic energy is directed over metal contacts.

Solid state electronics, such as varactor diodes, have been used to achieve phase shifting without the problems associated with mechanical shifters. However, these solid state electronic phase shifting methods are usually not compatible with high power levels due to their inherent nonlinearities, and active solid state solutions require power amplifiers which can be very large and expensive.

Phase shifters employing ferro-magnetic materials ("ferrites") change the phase of a signal in a feed line by applying a direct current magnetic field to the feed line. However, ferrite phase shifters can be very large, heavy, and expensive. While recently developed thin-film techniques have reduced their size to some extent, such ferrite phase shifters are usually nonlinear at high power levels making them inappropriate for multi-carrier communications operating at high power levels.

Other conventional phase shifting techniques use a mechanical movement of a dielectric material into electrical field lines, but the effective relative phase shift generated can be small for materials with low dielectric constants and hence require large-sized phase shifters for practical applications. For high-dielectric constant materials, a significant impedance mismatch can occur at the interface to the dielectric loaded region, which causes an undesirable return loss. Further, solutions with high dielectric materials are further prone to power loss into dielectric resonant modes. The competing mechanical and electrical demands for phase shifters, especially in constrained environments of many communications systems, makes most of these conventional designs inappropriate to meet the cost, size and performance requirements of certain systems, especially communication system antennas characterized by high power and multi-carrier use.

Consequently, there is a need in the art for a radio frequency (RF) phase shifter and method that is compact, low cost, durable and reliable in repeating phase shifting operation on RF signals, and that can support high power and multi-carrier RF applications. There is a further need for a method and system for producing linear phase shifts in RF Feed Lines that provide for a relatively low return loss, low power loss, while supporting large RF bandwidths and for an apparatus and method of phase shifting that produces little or no adverse PIM signals. A further need exists for a phase shifter and method that are highly reliable and consistent over numerous cycles and where the system can be manufactured with minimal re-tooling in production plants and at a reduced cost.

SUMMARY OF THE INVENTION

The present invention solves the aforementioned problems with a phase shifter and phase shifting method that can adjust the electrical phase of RF signals in a high power and muli-carrier RF environment, such as is used in controlling signals sent and received in a base station antenna. The phase shifter of the present invention can adjust the phase between signals in two segments of an RF feed line that are fed with the phase shifter. Specifically, the phase shifter can adjust the phase between signals in two RF feed line segments by changing the electrical path lengths that RF energy travels down each respective RF feed line segment.

In other words, the phase shifter can provide an efficient way to adjust the electrical phase of RF signals where RF energy is fed into a single input port and the resulting phased RF energy can be propagated from two or more output ports. The output ports can be coupled to various devices. According to one exemplary aspect of the invention, the output ports can be coupled to antenna elements of a phased antenna array.

The present invention can include a phase shifter operable on a substantially planar surface having a support structure and a coupling arm. The coupling arm can comprise a coupling ring, a wiper element and a mid portion connecting the coupling ring to the wiper element, with the coupling arm being rotatable about an axis centered relative to the coupling ring.

The phase shifter employs capacitive coupling between moving parts. The capacitive coupling between the moving parts can be maintained by providing a dielectric spacer between the coupling arm and feed lines disposed on the planar surface. The phase shifter can further comprise a spring assembly for uniformly applying a distributed pressure to the coupling arm to help maintain the aforementioned capacitive coupling. The spring assembly can be implemented as a thin and wide cylindrical structure that applies force over a large area of the coupling arm.

The phase shifter can also include support traces that are positioned on the arm as well as on a planar support structure that includes the feed lines that engage with the coupling ring and wiper element. The support traces can help facilitate smooth rotation of the phase shifter by providing opposing forces relative to the forces generated as the wiper element of the coupling arm moves over an output feed line.

The phase shifter can include a key cooperatively engaged to a shaft for transferring movement of the shaft to the coupling arm. The key can also provide rigid support to the coupling arm. A bearing-seal, which engages and circumscribes the shaft and is located in a hole in the tray, can facilitate smooth rotation of the phase shifter by providing a bearing surface for the outer diameter of the shaft. Further, the bearing-seal provides a moisture barrier and protects against the elements.

The materials of the present invention lend themselves to efficient and cost effective manufacturing of the phase shifter. The coupling ring, wiper element and the mid portion connecting the coupling ring to the wiper element of the coupling arm can be made from microstrip materials, such as copper, that can be formed during etching-type manufacturing processes. The coupling arm can further comprise a printed circuit board material.

The support structure that includes a spring, key, and bearing seal can be made from dielectric materials. The spring can be made from an elastic dielectric material. The aforementioned support structure couples to the planar surface. The planar surface can comprise a printed circuit board material.

Further, the support traces can be made from microstrip materials, such as copper, in order to be formed from during etching-type manufacturing processes. Alternatively, the support traces can be made out of dielectric materials.

The structure and method of the invention can provide a phase shifter that has low PIM, low return losses, supports large RF bandwidths and provides a highly reliable way to adjust phases in RF signals that is durable and repeatable over an extended life cycle.

The phase shifter can be rotated manually or with a machine such as a motor, for local or remote control.

According to other inventive aspects of the present invention, the present invention can inversely change the phase of signals in more than two feed line segments with a single phase shifter. The phase shifter can comprise a single coupling arm with two wiper elements that can adjust the phase for second and third feed lines.

In another exemplary aspect, the phase shifter can comprise two separate coupling arms that have separate wiper elements. The wiper elements can adjust the phase for signals in second and third feed lines. And according to yet another exemplary aspect of the invention, the phase shifter comprising two separate coupling arms can operate in tandem where each coupling arm has a gear that intermeshes with an opposing gear of an opposing coupling arm. The phase shifter can be further modified from use of its various embodiments to control the phase for multiple layers of feed lines disposed on different planar surfaces.

The phase shifter of the invention is of a simple construction, designed to minimize cost of both materials and assembly.

DETAILED DESCRIPTION OF THE EXEMPLARY EMBODIMENTS

Figure 1A:
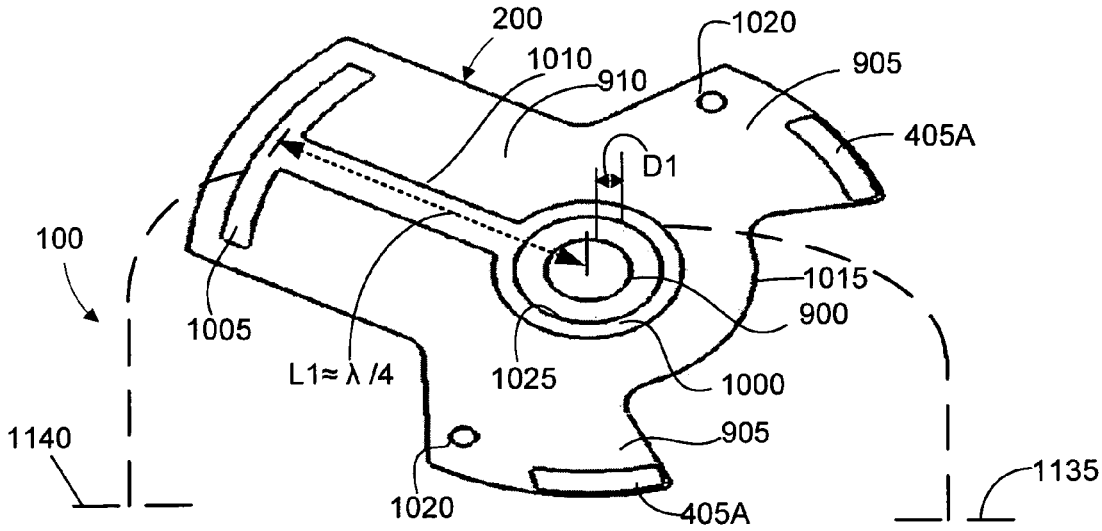
FIG. 1A is an illustration showing a bottom or rear view of a coupling arm of the phase shifter according to one exemplary embodiment of the present invention.

A phase shifter can comprise a coupling arm, a key, a spring, and a support architecture that fastens the phase shifter to a substantially planar surface while permitting rotation of certain components of the phase shifter relative to the planar surface. The support architecture can be rotated manually or with a machine such as a motor. The coupling arm can comprise a coupling ring, a wiper element, a support trace, and a dielectric spacer.

Referring now to the drawings, in which like numerals represent like elements throughout the several figures, aspects of the present invention and the illustrative operating environment will be described.

Referring now to FIG. 1A, this figure illustrates a bottom view of a coupling arm 200 according to one exemplary embodiment of the present invention. The side illustrated in FIG. 1A will face the side illustrated in FIG. 1B when the coupling arm 200 is rotatably fastened to a planar surface 140 illustrated in FIG. 1B.

The coupling arm 200 can comprise a coupling ring 1000, a wiper element 1005, a mid-portion 1010, a support trace 405A, and a dielectric support 1015. The coupling arm 200 comprising the coupling ring 1000, wiper element 1005, and mid-portion 1010 can have an electrical length L1 that is preferably (lamda)/4, where lambda is, very approximately, the wavelength of the propagating signal in the circuit.

The electrical length L1 of approximately a quarter wavelength of the propagating signal in the circuit can measured from a geometric center of the aperture 900 to a mid-point of the wiper element 1005 as illustrated in FIG. 1A. It is noted that the electrical length is approximately equal to this distance L1 of the coupling arm 200. And the actual physical size of coupling arm 200 is usually found experimentally for most applications.

For example, a free-space quarter-wavelength is 3.5 inches at 851 MHz. In DiClad microstrip (with out a top cap), the signal quarter-wavelength value is approximately 2.5 inches. With a top cap of dielectric, the signal quarter-wavelength value is less than 2.5 inches. The inventors have discovered that a coupling arm 200 in one exemplary embodiment having a dielectric support 1015 of DiClad measures 2.15 inches from the center of the wiper element 1005 to the center of the aperture 900. The same coupling arm 200 measures 2.55 inches from a rear portion of the coupling ring 1000 to the center of the wiper element 1005 as a straight line distance. This suggests that the effective electrical length L1 is between these two physical parameters.

This means that the coupling arm 200 can have other electrical lengths without departing from the scope and spirit of the present invention. That is, the electrical length L1 increased or decreased in size without departing from the present invention. As another example of adjusting the electrical length, L1 can have an electrical length of one-half of a wavelength at the operating radio frequency. Alternatively, the coupling arm 200 could have a length that is a multiple of one-quarter of a wavelength or one-half of a wavelength at the operating radio frequency.

Further, the electrical length could comprise magnitudes larger than one-half wavelength but it is noted that the operating bandwidth could be reduced with such electrical lengths that are greater than one-half of a wavelength of the operating radio frequency. Also, the exemplary quarter wavelength dimension can be adjusted (increased or decreased) if the size of the feed lines are adjusted or if the dielectric materials used within the phase shifter 100 are changed or both.

The wiper element 1005 can comprise an arc shaped member. However, other shapes are not beyond the scope of the present invention. The shape of the wiper element 1005 is typically a function of the shape of a feed line that is capacitively coupled with the wiper element 1005 as will be discussed below.

The coupling arm 200 in one exemplary embodiment has a dielectric support 1015 that can comprise a rigid material such as a printed circuit board (PCB), plastic, or a ceramic material. A preferred exemplary substrate material for the dielectric support 1015 is material identified as model RO-4003, available for Rodgers Microwave Products in Chandler, Ariz. The dielectric support 1015 of the coupling arm 200 does not necessarily need to be identical or substantially similar to the planar surface 140 (shown in FIG. 1B). For example, the dielectric support 1015 can comprise a rigid substrate, while the planar surface 140 (shown in FIG. 1B) can comprise a polytetrafluoroethylene (PTFE) laminate, this being the chemical name for TEFLON (TM) by DuPont.

The coupling ring 1000, wiper element 1005, mid-portion 1010, and support traces 405A disposed on the coupling arm 200 can comprise copper material. This copper material can comprise etched microstrip transmission lines. This copper material can also be coated with tin as applied through a plating process to provide a protective layer for the copper against oxidation or corrosion, or both. Alternatively, support traces 405A can be constructed from dielectric materials. However, when the support traces 405A are constructed with the same material as the coupling ring 1000, wiper element 1005, mid-portion 1010, such a design lends itself to efficient and cost effective etching manufacturing processes.

The coupling arm 200 further comprises an aperture 900, wing portions 905, and an arm portion 910. The wing portions 905 are designed to correspond with the first set of support traces 405A and give added support for maintaining a level position of the coupling arm 200 relative to the planar surface 140 throughout the coupling arm's range of rotation. Specifically, the wing portions 905 are shaped to correspond with a shape of the support traces 405A in order to minimize the amount of the surface area of the coupling arm 200 in order to conserve materials and also to reduce any affects the materials may have on RF propagation. The coupling arm 200 can further comprise secondary apertures 1020 that can receive a fastening mechanism, if desired, to connect the coupling arm 200 to a key 210 (discussed below in FIGS. 6 and 7).

The coupling ring 1000, wiper element 1005, and mid-portion 1010 are preferably constructed as relatively flat or planar elements that remain flat or substantially planar throughout the full range of movement across the distribution network 120. The shape of the coupling arm 200 comprising the arm portion 910 and wing portions 905 facilitate the balance loading of the coupling arm 200 to permit smooth rotation while maintaining this relatively flat design through full ranges of the coupling arm's circular rotation.

The coupling ring 1000 has an interior circumference 1025 that is spaced apart from the edge of the aperture 900 by a first predetermined distance D1. This spacing D1 can be calculated mathematically or empirically in order to reduce or substantially eliminate any passive intermodulation (PIM). For example, if a shaft 245 (not shown in FIG. 1A but shown in FIG. 8 discussed below) penetrates through the aperture 900, then the first predetermined distance D1 can substantially reduce or eliminate any PIM that could be produced between the coupling ring 1000 and shaft 245.

Figure 1B:
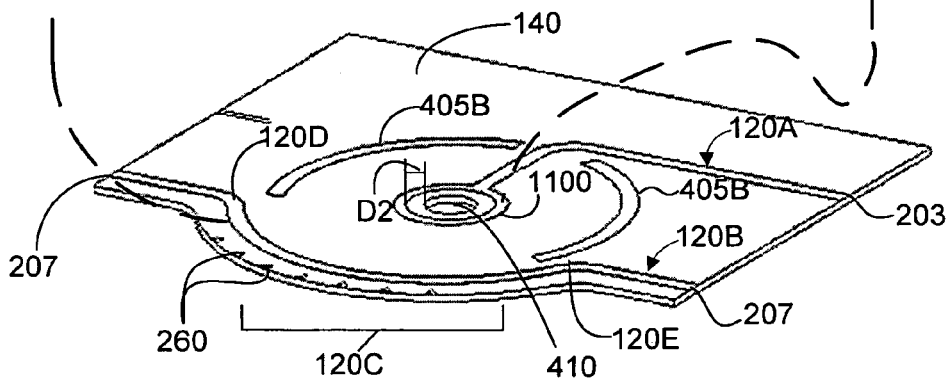
FIG. 1B is an illustration showing a planar surface that supports a first feed line and a second feed line of an exemplary phase shifter according to an exemplary embodiment of the present invention.

The overall shape of the coupling arm 200 is typically a function of the number of feed lines that will be interacting with the coupling arm 200 and is shaped to keep a balanced load across the coupling arm 200 as the coupling ring 1000, wiper element 1005, and mid portion 1010 are capacitively coupled with corresponding structures on the planar surface 140 (shown in FIG. 1B). The shape of the coupling arm 200 is further dependent upon a design to reduce the amount of dielectric or metallic material that is adjacent to the traces on the planar surface 140 throughout the circular movement of the coupling arm.

Referring now to FIG. 1B, this figure illustrates the planar surface 140 that may support various segments of the feed lines 120 that interact with the wiper element 1005. The planar surface 140 in one exemplary embodiment preferably comprises a dielectric material with a dielectric constant of approximately 3.38, such as material that can be obtained from Rogers Corporation of Chandler, Ariz. sold as model No. RO-4003. Alternatively, the planar surface 140 can comprise a PTFE laminate.

The planar surface 140 further comprises a coupling ring 1100 that is part of a first feed line 120A. The coupling ring 1100 of the first feed line 120A comprising an input port SN is also spaced from an aperture 410 by a predetermined second distance D2. Second distance D2 can be determined mathematically or empirically in order to reduce any PIM when the support architecture 240 comprises metallic components, similar to the first predetermined distance D1 discussed above.

The geometry of the coupling ring 1100 that forms part of the first feed line 120A generally corresponds with the geometry of the coupling ring 1000 of the coupling arm 200. This similar geometry yields a proper impedance match to optimize an input signal's RF power to be propagated through the coupling arm 200 as the coupling arm 200 is rotated. This similar geometry also provides increased contact area and reliability between the respective coupling rings 1000, 1100 on the coupling arm 200 and planar surface 140.

The planar surface 140 further comprises a second feed line 120B that also includes a shaped portion 120C that corresponds with the shape of the wiper element 1005 of the coupling arm 200. The first and second feed lines 120A, 120B, as well as a second set of support traces 405B disposed on the planar surface 140 can comprise microstrip transmission lines that are etched from a printed circuit board material. Specifically, the first and second feed lines 120A, 120B, as well as the support traces 405B disposed on the planar surface 140 can comprise copper materials coated with tin. However, as noted above, the support traces 405B can comprise dielectric materials instead of conductive materials.

The first and second pairs of support traces 405A, 405B disposed on the coupling arm 200 and on the planar surface 140 help facilitate the smooth rotation of the phase shifter 100 by providing opposing forces relative to the forces generated as the wiper element 1005 of the coupling arm 200 moves over the second feed line 120B. By facilitating this smooth rotation, the support traces 405A, 405B can provide a condition so that there are even forces on the traces 405A, 405B to minimize wear to provide a consistent desired spacing at the two capacitive junctions discussed above. The reduction of wear is important when the feed lines 120 and coupling arm 200 have a very small thickness. Specifically, the conductive feed lines 120 have a small thickness or height above the planar surface that supports them. The height of these microstrip lines 120 typically is that associated with one-half or one ounce copper, a term known to those familiar with the art. Thinner or thicker microstrip lines (smaller or larger degrees of microstrip's height about the planar surface it is manufactured on) can be used in the described phase shifter 100. The support traces 405A, 405B can be sized in length, width, and thickness such that they do not interfere with the electrical characteristics of the feed lines when RF energy is being propagated.

The location of the support traces 405B positioned on the planar surface 140 correspond with the location of the matching support traces 405A disposed on the wings 905 of the coupling arm 200. The thickness of the support traces 405B on the wings 905 and the thickness of the support traces 405A on the planar surface 140 compensate for the thickness of the remaining traces that are aligned between the coupling arm 200 and the feed lines 120. Basically, the support traces 405 keep the coupling arm 100 level and parallel to the face of the planar surface 140 during rotation, and reduce wear on the capacitively-coupled rings 1000, 1100 and other traces. The semi-circular design of the support traces 405 allow the coupling arm to be held in position on the face of the planar surface 140 in a very stable fashion throughout the circular movement of the coupling arm 200.

A first portion 120D of the shaped feed line portion 120C that corresponds with the shape of the wiper element 1005 represents one exemplary position for the coupling arm 200 after it rotates and traverses the shaped feed line portion 120C. A second portion 120E of the shaped feed line portion 120C that corresponds with the wiper element 1005 can represent a second exemplary position for the coupling arm 200 after it rotates and traverses the shaped feed line portion 120C.

The wiper element 1005 is capacitively coupled to the shaped feed line portion 120C of the second feed line 120B in order to achieve low PIM effects. As noted above, capacitive junctions and non-metallic materials for selected components of the phase shifter 100 are used to prevent, where possible, direct physical contact between conductive metal surfaces in order to further minimize the generation of PIM in a high power, multi-carrier RF environments.

Capacitive junctions 1135, 1140 indicated by dashed lines between FIGS. 1A and 1B are formed by the following structures: (1) the combination of the wiper element 1005, a dielectric spacer 400 (illustrated in FIG. 1C), and the shaped feed line portion 120C of the second feed line 120B; and (2) the combination of the conductive ring 1000 of the coupling arm 200, the dielectric spacer 400 (illustrated in FIG. 1C), and the coupling ring 1100 that is part of the first feed line 120A. These capacitive junctions can facilitate the transfer of an input RF signal from the phase shifter 100 to the outputs or first and second portions 120D, 120E of the shaped feed line portion 120C.

An input section of the phase shifter 100 can be represented by a first capacitive junction 1135 formed by the coupling rings 1000, 1100. An output section of the phase shifter 100 can be represented by second capacitive junction 1140 formed by the combination of the wiper element 1005 and the shaped feed line portion 120C of the second feed line 120B.

The inventors have discovered it is desirable to minimize the radius of the coupling arm 200 in order to achieve a more reliable contact, namely a well-balanced and distributed contact between the capacitively coupled traces of the coupling arm 200 and the feed lines 120A and 120B. In one exemplary embodiment, the radius of the coupling element 200 comprises 1.68 inches for a cellular telephony design comprising the five antenna elements.

The phase shifter 100 can comprise a relatively compact structure in order to evenly distribute the compressive load on the coupling arm 200, which in turn, maintains the predetermined value of capacitance between the rings 1000, 1100 and between the wiper element 1005 and shaped portion 1115 of the second feed line 1110. The compressive load also maintains the predetermined value of capacitance between the wiper element and a second feed line. While the phase shifter 100 can comprise a relatively compact structure, the structure can be sized or dimensioned to achieve a full range of movement necessary to produce various levels of desired electrical phase shifts.

Figure 1C:
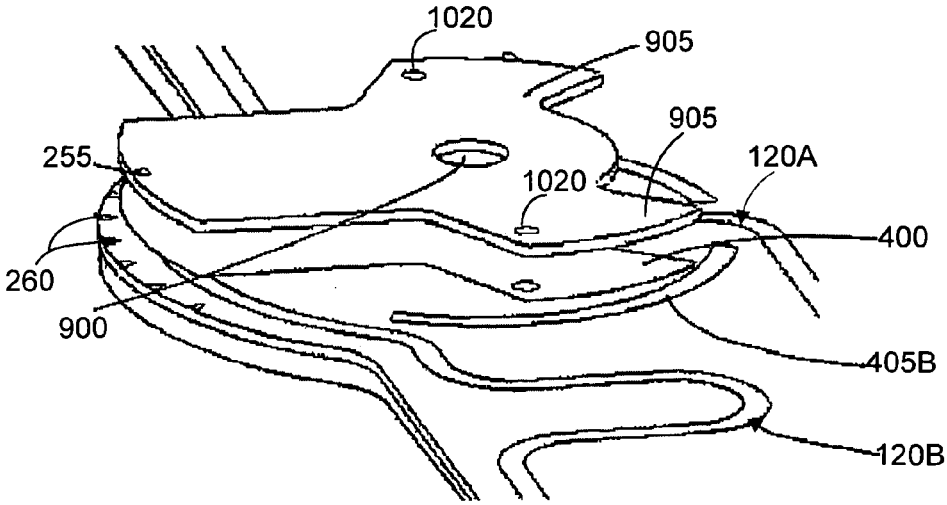
FIG. 1C is an illustration showing an isometric view of an exemplary coupling arm according to one exemplary embodiment of the present invention.

Referring now to FIG. 1C, this figure illustrates further details of the phase shifter 100 according to one exemplary embodiment of the present invention. This figure illustrates a dielectric spacer 400 that generally has a shape that corresponds with the shape of the coupling arm 200. The dielectric spacer 400 can comprise a thin piece of adhesive-backed plastic, such as an insulator strip, that can be attached to a bottom surface of the coupling arm 200. However, the present invention is not limited to the dielectric spacer discussed above. Other materials for the dielectric spacer 400 can be used without departing from the scope and spirit of the present invention.

For example, one preferred dielectric is the use of a sheet of dielectric that covers the underside of the coupler arm 200. Soldered mask can also be used as the dielectric spacer 400. A combination of solder mask and a dielectric material could also be used. Further, any entire sheet of dielectric or covering of solder mask is not necessary, although using a complete cover gives both the capacitive coupling and also an even structure for reliable mechanical performance.

Segments of a dielectric material, or a solder mask, or a combination of the two can be used. Also, any number of layers of a dielectric are possible. Thus, while one layer of a dielectric sheet is used in the preferred embodiment, it is understood that various combinations as described are possible give the desired mechanical support at this juncture and the desired capacitive coupling performance.

In one exemplary embodiment, the dielectric spacer 400 comprises an insulator strip of a relatively high dielectric (compared to that of the planar surface 140) and with a low loss tangent property. In another exemplary embodiment, the dielectric spacer can comprise an adhesive-backed material with a dielectric constant of approximately 3.5 and a low loss tangent factor of approximately 0.01, as is made by Shercon, Inc. of Santa Fe Springs, Calif.

More than one layer of dielectric tape, solder mask, or a combination of thereof can be used for the dielectric spacer 400. The spacer 400 can be cut out to cover the electrical parts selectively on one of the coupling arm 200 and planar surface 120, or on both surfaces. Those skilled in the art recognize that a lot of variations can be employed to achieve the insulating function of the present invention. These variations can be selected to give optimum mechanical performance with a substantially level surface at which the two RF signal couplings take place, and to create the desired spacing for optimal signal transmission through the phase shifter 100.

The dielectric spacer 400 can have a thickness of approximately two millimeters. However, depending upon the conductive and dielectric materials selected, the dielectric spacer 400 can have increased or decreased thickness relative to the exemplary dimension provided above.

The adhesive (not shown) of the dielectric spacer 400 allows the dielectric spacer 400 to move with the coupling arm 200 as the coupling arm 200 is rotated. The dielectric spacer 400 can provide a very small and constant distance of separation between the conductive elements of the coupling arm 200 and portions of the feed lines 120 such that capacitive junctions (discussed above) are formed between conductive elements of the coupling arm 200 and portions of the planar surface 140. The dielectric spacer 400 can prohibit a direct current (DC) path from forming between certain conductive elements on the coupling arm 200 and portions of the feed lines 120.

FIG. 1C further illustrates use of an indicators 255 and markings 260 disposed on the wiper arm 200 and planar surface 140, respectively. The markers and indicators 255, 260 can insure a proper setting of the radial position of the coupling arm 200. The indicator 255 and markings 260 can also serve as a reference to determine whether a wiper element (not shown in this figure) is properly aligned at a desired point on feed lines 120B.

Figure 2:
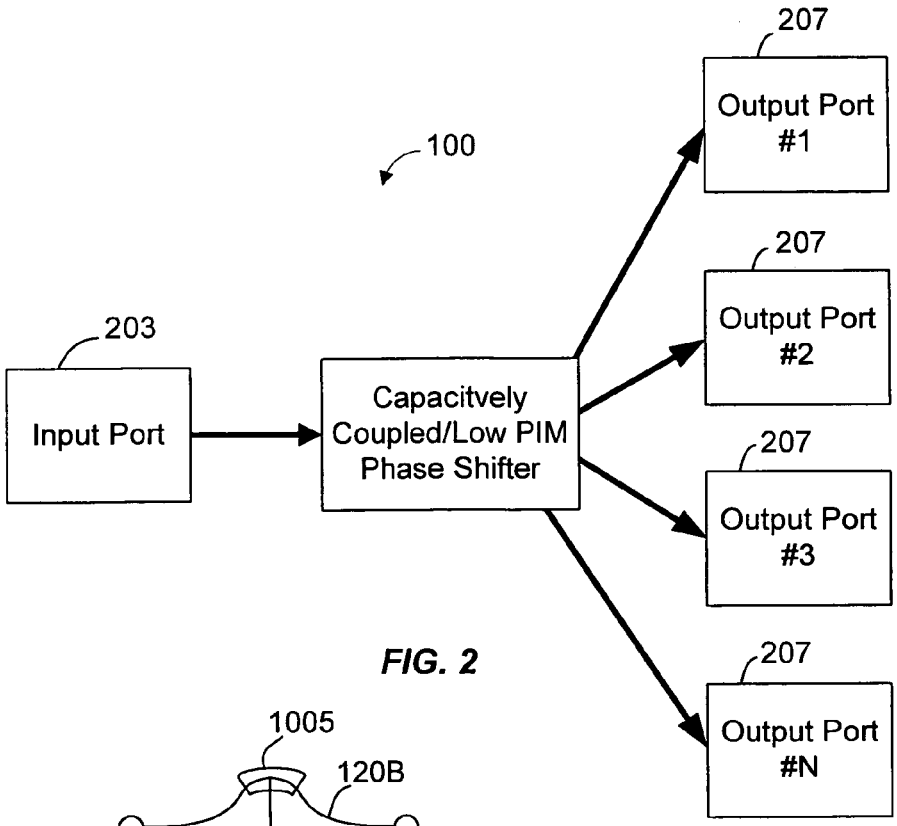
FIG. 2 is a functional block diagram illustrating a phase shifter with a single input port and multiple output ports.

Referring now to FIG. 2, this figure is a functional block diagram illustrating an exemplary phase shifter 100 with a single input port 203 and multiple output ports 207. As will be discussed below, the phase shifter 100 comprises an efficient design where multiple output ports 207 can be phased with a single coupling arm 200 (not shown in FIG. 2) that provides capacitive junctions between the first input port 203 and multiple output ports 207. FIG. 2 illustrates that the present invention is not limited to the four output ports 207 shown. Any number of output ports 207 could be employed without departing from the scope and spirit of the present invention.

The output ports 207 can be coupled to any one of a number of devices. In one exemplary embodiment, the output ports 207 can be coupled to antenna elements 115 (shown in FIG. 10 below). However, the phase shifter 100 of the present invention is not limited to only antenna applications. Other applications of the phase shifter 100 are not beyond the scope and spirit of the present invention. For example, the output ports of the phase shifter 100 could be coupled to a power divider.

Figure 3:
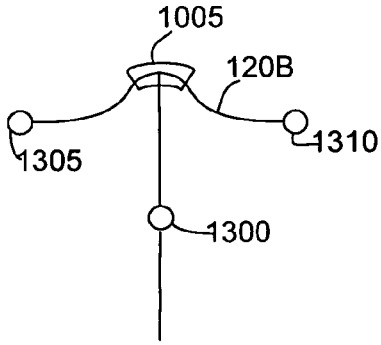
FIG. 3 is an illustration showing a single wiper element for two output ports according to one exemplary embodiment of the present invention.

Referring now to FIG. 3, this figure illustrates a design where a single wiper element 1005 can adjust the phasing between two output ports 1305, 1310 relative to an input port 1300.

Figure 4:
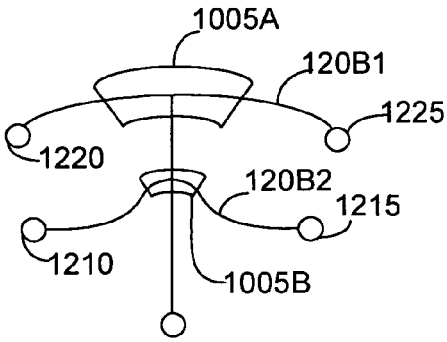
FIG. 4 is an illustration showing a double wiper element for four output ports according to one alternative exemplary embodiment of the present invention.

Referring now to FIG. 4, this figure illustrates an exemplary alternative embodiment where a coupling arm comprises two wiper elements 1005A, 1005B. Each respective wiper element 1005A, 1005B is designed to be coupled to one of two feed lines 120B1, 120B2. FIG. 4 also illustrates the simplicity and efficiency of the invention where numerous feed lines can be controlled with a single coupling arm 200. FIG. 4 also illustrates a single input port 1205 for the phase shifter and four outputs 1210, 1215, 1220, and 1225.

Figure 5:
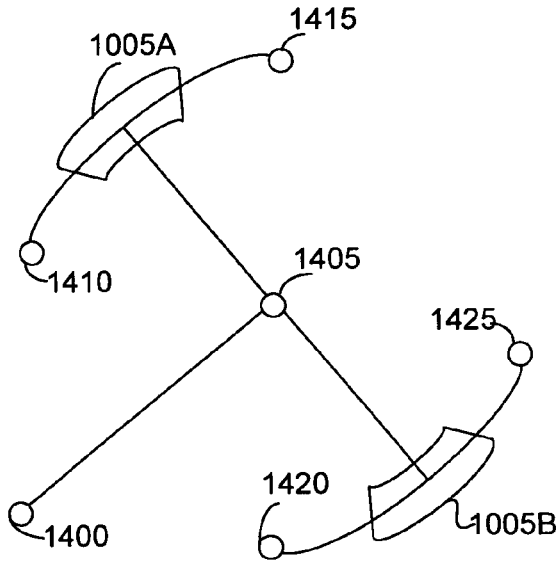
FIG. 5 is an illustration showing a diametrically opposed-double wiper element for four output ports according to another alternative exemplary embodiment of the present invention.

Referring now to FIG. 5, this figure illustrates a dual wiper element design, wherein each wiper element 1005A, 1005B is coupled to a single input port 1400 at a central pivot point 1405 and rotates between a pair of output ports 1410, 1415, 1420 and 1425 positioned opposite to each other. The wiper elements 1005A, 1005B are disposed diametrically opposite to one another.

Figure 6:
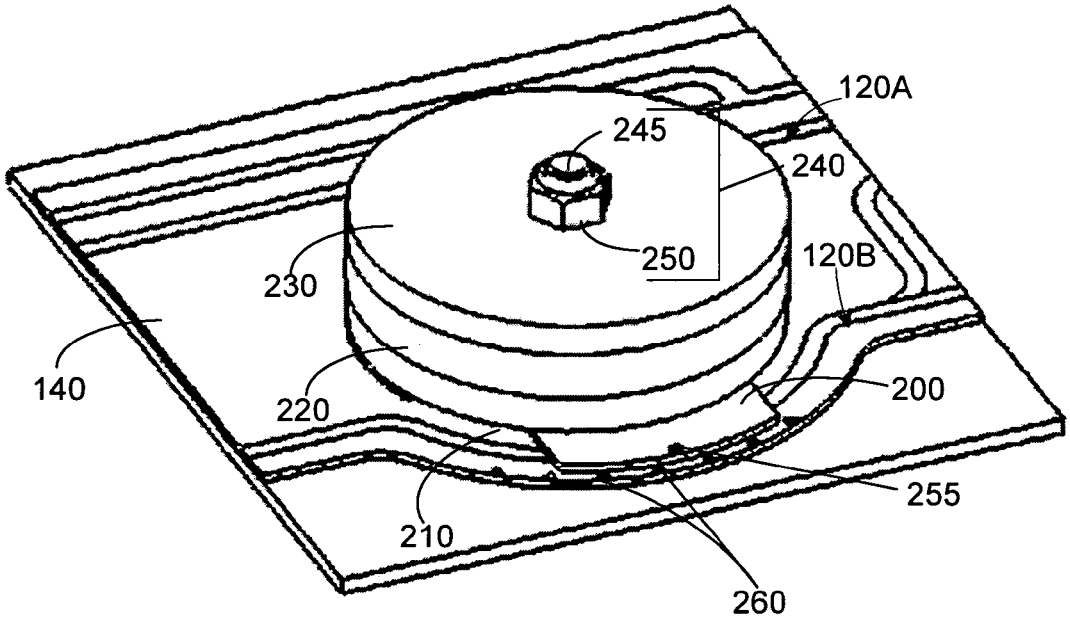
FIG. 6 is an illustration showing an isometric side view of an assembled phase shifter according to an exemplary embodiment of the present invention.

Referring now to FIG. 6, this figure illustrates a perspective view of assembled components of an exemplary phase shifter 100 mounted on the planar surface 140. The phase shifter 100 illustrated in FIG. 6 can comprise a coupling arm 200, a key 210, a spring 220, and a washer 230. These elements are held together by a support architecture 240 that can comprise a shaft 245 and a nut 250. Either the shaft 245 or the nut 250 may be made from a conductive material, while the other is nonconductive, or both can be made from nonconductive materials. The washer 230 and key 210 are preferably constructed from non-metallic materials according to one exemplary embodiment of the present invention.

The spring 220 can be implemented as a thin and wide, cylindrical structure that applies force over a large area of the coupling arm 200. In one exemplary embodiment, the key 210 comprises a plastic disk. However, other dielectric materials are not beyond the scope and spirit of the present invention.

Those skilled in the art will also appreciate that the selection of nonconductive materials for various components of the phase shifter 100 can be important in order to prevent PIM problems. The selection of non-conductive materials for the various components of the phase shifter 100 is also important to maintain good dielectric properties for RF signal propagation.

Movement of the coupling arm is effectuated by shaft 245 interacting with the key 210. The shaft 245 is typically assembled by inserting it through an aperture 410 disposed in the planar surface 140. The phase shifter 100 is positioned proximate to an aperture 410 (shown in FIG. 1A) disposed in the planar surface 140 to allow the shaft 245 to pass through the planar surface 140 and to interact with the key 210 to effectuate movement of the coupling arm 200. The combination of the support architecture 240, washer 230, spring 220, key 210, and coupling arm 200, applies downward pressure on the coupling arm 200 while allowing the shaft 245 to rotate the coupling arm 200 through a relatively full range of circular motion.

Figure 7:
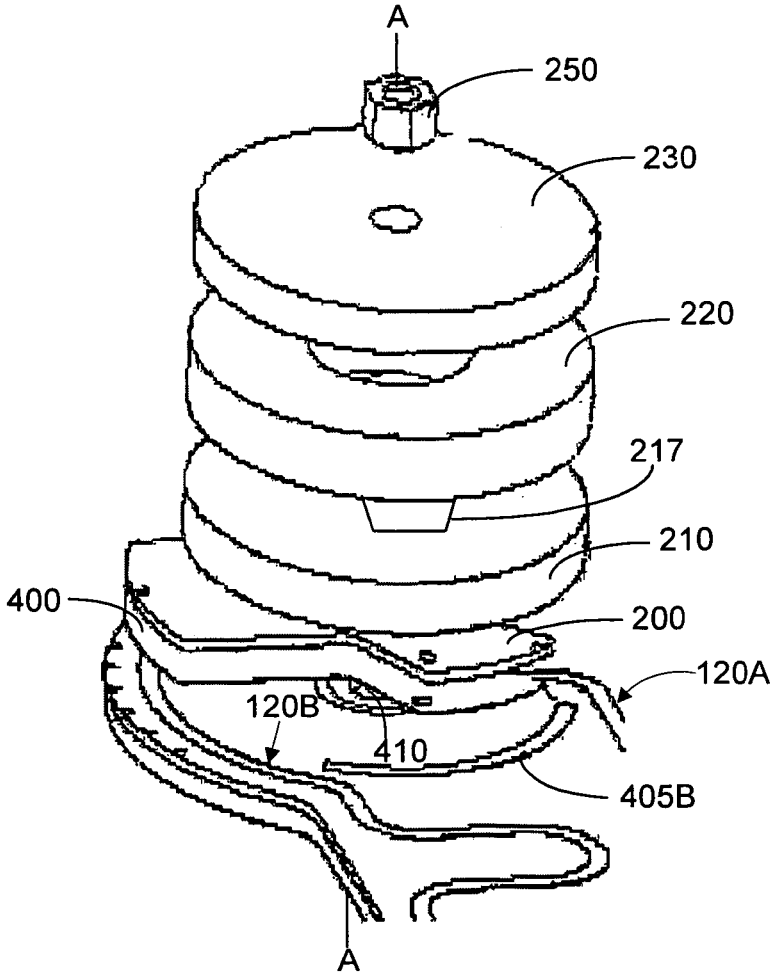
FIG. 7 is an expanded illustration showing a typical mounting arrangement on one side of the planar surface for a phase shifter of an exemplary embodiment of the present invention.

Referring now to FIG. 7, this figure illustrates a typical mounting arrangement for the phase shifter 100 according to an exemplary embodiment of the present invention. In this figure, the shaft 245 has been removed for clarity and to illustrate the relative placement of exemplary mechanical elements that can support the coupling arm 200. The present invention is not limited to the mechanical elements shown. Other mechanical elements that can support coupling arm 200 are not beyond the scope and spirit of the present invention.

The phase shifter 100 comprises a coupling arm 200, a dielectric spacer 400, a key 210, a spring 220, and a washer 230, and support traces 405B (one shown in FIG. 7; both shown in FIG. 1B) on the planar surface 140. In this view, the aperture 410 in which the shaft 245 (not shown) passes through is illustrated. As noted above, the support traces 405B on planar surface 140 help facilitate smooth rotation of the phase shifter 100 by providing an opposing force relative to the force generated when conductive elements such as supports 405A and wiper element 1005 of the coupling arm 200 are pressed against portions of the feed lines 120 by the shaft 245 and nut 250.

The shaft 245 (shown in FIG. 6) is coupled to the key 210 by a sliding fit of hexagonal-shaped features. Specifically, the key 210 comprises a hexagonal aperture 217 that mates with a hexagonal portion (not shown) of the shaft 245 (shown in FIG. 6) to the coupling arm 200, thereby preventing backlash during rotation of the shaft 245. Other shapes of the aperture 217 and corresponding section of the shaft 245 are not beyond the scope of the invention. The key 210 can be precisely aligned to the coupling arm 200 by tooling and is preferably attached to the coupling arm 200 by double-sided dielectric tape 221 (shown in FIG. 8A). Other attachment mechanisms other than double-sided dielectric tape 221 are not beyond the scope and spirit of the present invention.

The key 210 can form a link between the coupling arm 200 and the support architecture 240 that includes the nut 250 and shaft 245. That is, the key 210 can be attached to the shaft 245 and the coupling arm 200 can be attached to the key such as any rotation of the key 245 by the shaft 245 can cause rotation of the coupling arm 200. In this way, wear of direct connections between the coupling arm 200 and the shaft 245 caused by rotation of the shaft 245 can be substantially eliminated. Further, the coupling arm 200 can be made from materials that can have less rigidity and strength since a direct connection between the shaft 245 and coupling arm 200 is not necessary when using the key 210.

The selection of the dielectric material for the key 210 is but one of the inventive aspects of the present invention since it has been discovered that the presence of a key 210 proximate to the coupling arm 200 can affect the phase of the RF signal that is being transported or propagated by the coupling arm 200 itself. Preferably, the key 210 is made of material having a relative dielectric constant of 1 to 5.

The components illustrated in FIG. 7 of the phase shifter 100 are compressed together by the spring 220 and support architecture 240 (that includes the nut 250 and shaft 245) with such a magnitude that permits rotation of certain phase shifter components such as the coupling arm 200 about a central axis A—A and the support architecture 240 while maintaining a predetermined spacing between the coupling arm 200 and the planar surface 140.

The spring 220 and support architecture 240 can provide a consistent compressive force during numerous rotations of the coupling arm 200. The compressive force of the spring 220 and support architecture 240 in combination with the dielectric spacer 400 maintains a constant and predetermined spacing between: the conductive ring 1000 of the coupling arm 200 and conductive ring 1100 of the first feed line 120A on the planar support 140; and between the conductive wiper element 1005 and second feed line 120B on the planar support 140, such that these elements can be capacitively coupled together when RF energy is propagated. The washer 230, the spring 220, and key 210 are preferably of a diameter comparable to the diameter of the coupling arm 200 such that the applied force to these components causes the coupling arm to have a balanced loading and firm contact with the substantially planar surface 140 and feed lines 120.

Figure 8A:
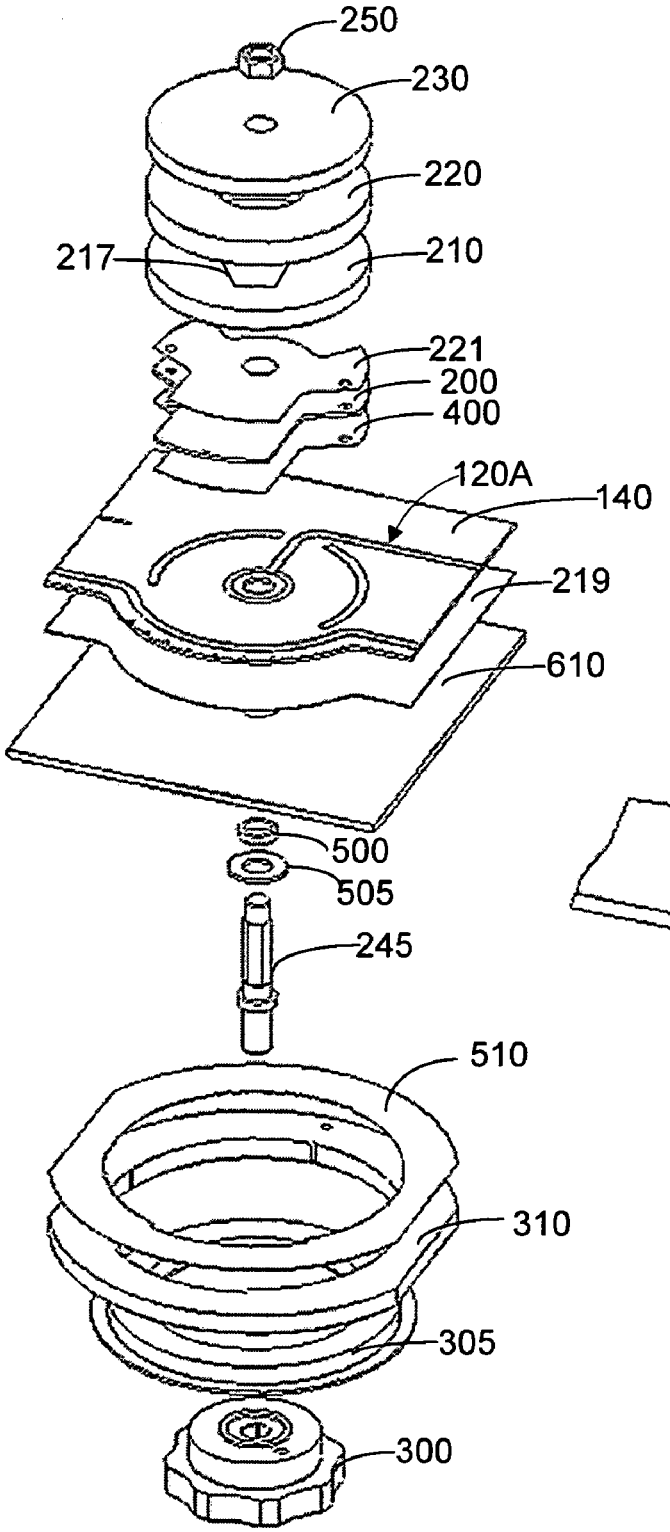
FIG. 8A is an expanded illustration showing a typical mounting arrangement for a first and second side of the planar surface according to an exemplary embodiment of the present invention.

Referring now to FIG. 8A, this figure illustrates a typical mounting arrangement including the support architecture 240 that is positioned on an opposite side of the planar surface 140 relative to the coupling arm 200. The support architecture 240 can further comprise a bearing seal 500, a washer 505, and tape 510. The tape 510 can comprise a dielectric material and is positioned between a conductive ring 310 and a conductive surface of an conductive support tray 610 to prevent a direct connection between conductive materials and thereby minimizing the generation of PIM at that junction. In a preferred exemplary embodiment of the phase shifter 100, the tape 510 can be used to mount the ring 310 to a support tray surface. The ring 310 can be designed to circumscribe and engage with a skirt assembly 305.

The coupling arm 200 can be fastened the key 210 with a dielectric tape or transfer adhesive 221. However, other fastening mechanisms can be used to attach the coupling arm 200 to the key 210 with out departing from the scope of the present invention.

Figure 8B:
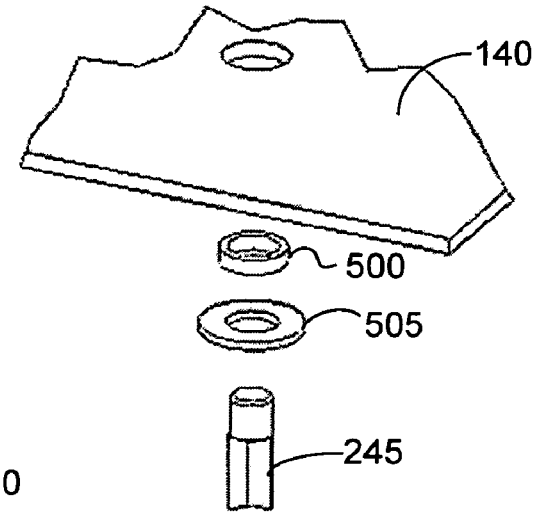
FIG. 8B is an illustration showing an enlarged view of a bearing seal according to one exemplary embodiment of the present invention.

Referring now to FIG. 8B, this figure illustrates an enlarged view of the bearing seal 500. The bearing seal 500 forms a part of the support architecture 240 and can also help facilitate smooth rotation of the phase shifter 100. This bearing seal 500 can be positioned on a side of the planar surface 140 that is opposite the surface 140 for supporting the feed lines 120A and 120B.

The bearing seal 500 can be positioned around the shaft 245 and can provide dual functions: Firstly, the bearing seal 500 can act as a bearing for the shaft 245 by providing balanced loading of the shaft 245. This balanced loading can reduce wear between the moving and stationary elements of the phase shifter 100 disposed on the opposite side of planar surface 140. The seal 500 can comprise a spring coupled to a dielectric ring (not shown), or an "O"-ring type formed of elastomer material or the like. Secondly, the seal 500 can form a liquid impervious barrier around the shaft 245 and prevents environmental elements such as water, dust, dirt, debris, etc. from entering the volume occupied by the phase shifter 100 on the opposite side of the planar surface 140. The bearing-seal used in one preferred embodiment is a spring-energized U-cup FlexiSeal, P/N VS-100-012-S-08, made by Parker Hannifin Corporation, Hampshire Ill.

Referring back to FIG. 8A, a knob 300 is coupled to the shaft 245. Turning the knob 300 can result in movement of the coupling arm 200 with little or no backlash. With this assembly, rotational force can be directly transmitted from the knob 300 to the shaft 245 to the key 210 and, in turn, to the coupling arm 200.

FIG. 8A further illustrates how the planar surface 140 supporting the feed lines 120 can be attached to the support tray 610, typically made of metal for strength. Specifically, the planar surface 140 can be attached to the support tray 610 by using double-side adhesive tape 219. Such a connection between the printed circuit board material 140 and the support tray 610 can minimize the generation of PIM that normally arises from the direct connection of conductive surfaces in a high-power RF applications.

Figure 9:
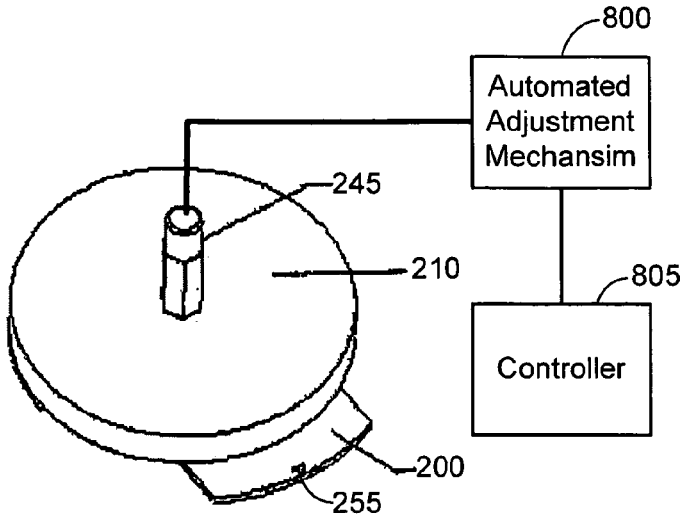
FIG. 9 is a combination functional block diagram and isometric view of some elements of the exemplary phase shifter according to one exemplary embodiment of the present invention.

Referring now to FIG. 9, this figure illustrates a combined functional block diagram and an isometric view of the key 210, shaft 245, and coupling arm 200. As noted above, the shaft 245 can be rotated with a manually operated mechanism such as a knob 300 or alternatively, the shaft 245 can be rotated with an automated adjustment mechanism 800. The automated adjusted mechanism 800 can comprise a motor. Exemplary motors include, but are not limited to, direct current motors and alternating current motors.

The automated adjustment mechanism 800 can be coupled to a controller 805 that controls the amount of movement performed by the automated adjustment mechanism 800. The controller 805 can comprise a computer running software, a microprocessor of a circuit board, or a hard-wired apparatus, or any combination thereof. The controller 805 can be linked to the automated adjustment mechanism via one of metal cables, optical fiber cables, wireless links such as an RF Link, and other types of communications path.

Those skilled in the art will appreciate that the controller 805 can operate according to a program or instructions received from a user. In turn, the controller 805 can issue commands to the automated adjustment mechanism 800, which could contain a read-only-memory (ROM) with preset phasing stored in memory and recall by signals from the controller 805.

Figure 10:
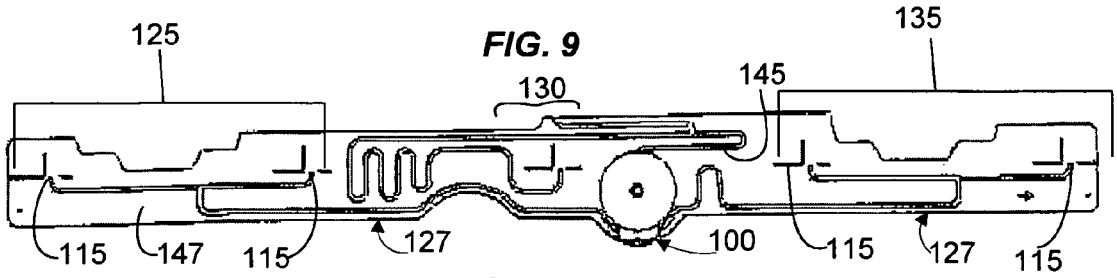
FIG. 10 is an illustration showing an elevational view of the construction of an exemplary embodiment of the present invention.

Referring now to FIG. 10, this Fig. is an elevational view of a phase shifter 100 that can control the electrical phase of an antenna array 110. The antenna array 110 can comprise radiating elements 115 and a distribution network 127. The antenna array 110 can comprise a top 125, a middle 130, and bottom 135 antenna groups corresponding to three phase groups wherein each antenna group comprises one or more radiating elements 115. The three antenna groups 125, 130, and 135 can form a linear array 110 extending along a longitudinal axis A—A of a distribution network 127 which, in turn, is attached to an antenna tray (not shown) that operates as a ground plane for the antenna array 110.

The irregular profile of the distribution network 127 allows an efficient use of printed circuit board material to manufacture multiple copies of the distribution network 127, as the network 127 can be nested on an entire panel of printed circuit board (PCB) material 147. The distribution network 127 is typically attached to the antenna tray (not shown) by using double-sided adhesive tape 219, thereby minimizing the generation of passive intermodulation (PIM) effects that can normally arise from direct connection of conductive surfaces in a high power antenna assembly that propagates RF currents.

The PCB or "board" 147 can support the distribution network 127 that can comprise microstrip transmission lines or "traces" to distribute signals to the antenna groups 125, 130, 135, and the ground plane (not shown) on a side opposite to the side illustrated in FIG. 1. The ground plane (not shown) can comprise a conductive surface and is preferably mounted to the antenna tray by dual-sided adhesive material, thereby forming a capacitive junction between the conductive surfaces of the antenna tray and the ground plane of the distribution network 127.

An antenna connector (not shown) can be connected to the distribution network 127 to carry signals between the antenna elements 115 and a source, such as a receiver and/or a transmitter.

An input of a power divider (not shown) of the distribution network 127 is coupled to an antenna connector (not shown) while outputs of the power divider (not shown) are coupled to the phase shifter 100 and to the middle antenna group 130. The phase shifter can be coupled to the top and bottom antenna groups 125, 135 via the distribution network 127. The exemplary phase shifter 100 can adjust the phase angle of an RF signal routed between the antenna connector (not shown) and the top and the bottom antenna groups 125, 135. In contrast, the phase angle of the RF signal routed between the antenna connector (not shown) and the middle antenna group 130 remains constant based on a fixed length of micro-strip transmission line 145 connecting the middle antenna group 130 and the antenna connector (not shown).

Those skilled in the art will appreciate that the phase shifter 100 can be placed at a different location on the distribution network 127 by adjusting the lengths of the feed traces coupled to the antenna groups 125, 130, 135. Although the exemplary embodiment illustrated in FIG. 10 employs a single-phase shifter 100 for controlling the down tilt angle of the electromagnetic radiation pattern formed by the antenna array 110, alternative designs for a variable electrical down tilt antenna array can employ a combination of multiple phase shifters to control the electrical down tilt angle of the antenna as will be discussed below with respect to FIGS. 11–13 and 16–17.

Figure 11:
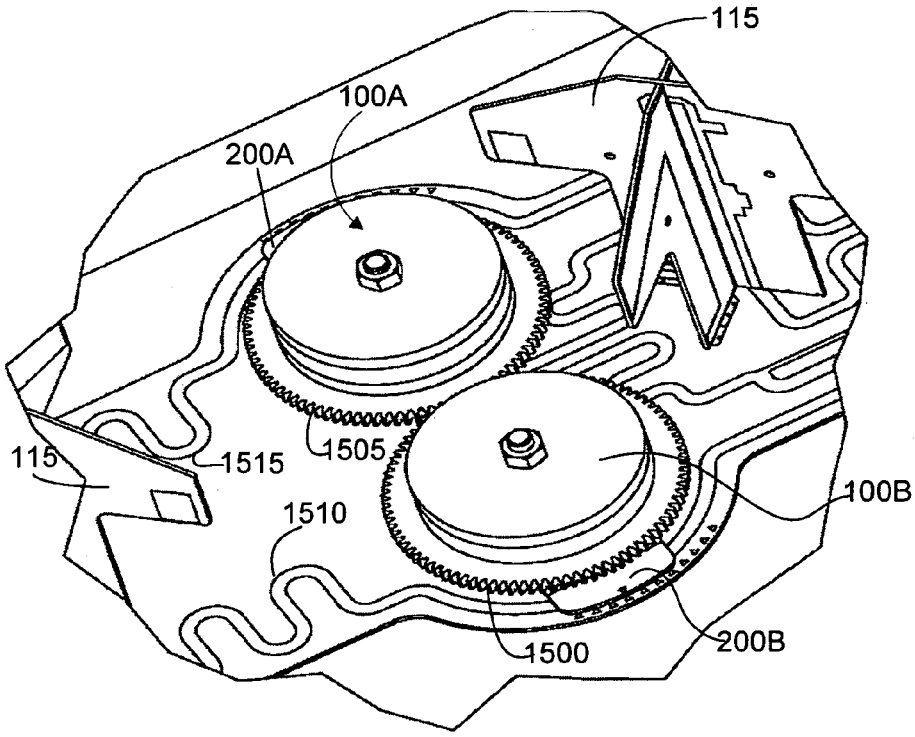
FIG. 11 is an illustration showing a phase shifter having two separate coupling arms that can operate in tandem where each coupling arm can include a gear that inner meshes with an imposing gear of an opposing coupling arm according to another alternative exemplary embodiment of the present invention.

Referring now to FIG. 11, this figure illustrates an alternate exemplary embodiment in which the phase shifter 100 can comprise two separate coupling arms 200A, 200B, that have separate wiper elements. The coupling arms 200A, 200B, can adjust the phase for second and third feed lines 1510, 1515. The two separate coupling arms 200A, 200B, can operate in tandem with each coupling arm 200A, 200B having a gear 1500, 1505 that intermeshes with an opposing gear of an opposing coupling arm. Specifically, in the exemplary embodiment illustrated in FIG. 11, gear 1500 intermeshes with gear 1505 of the phase shifter 100A having coupling arm 200A.

Figure 12:
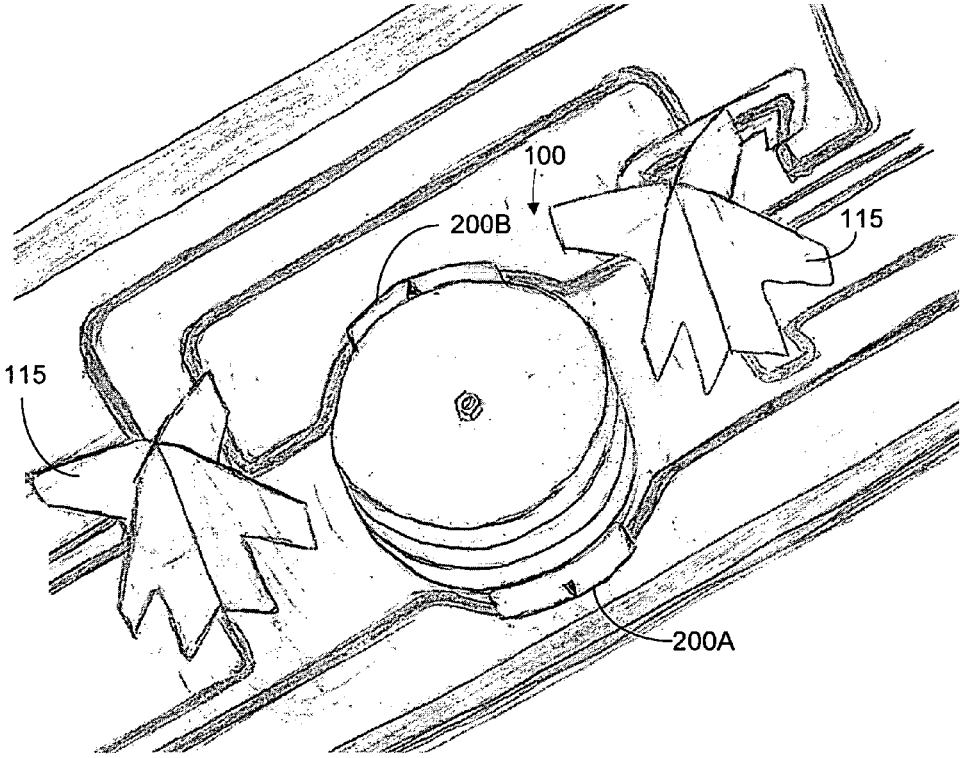
FIG. 12 is an illustration showing an exemplary phase shifter having a single coupling arm with two wiper elements that can adjust the phase for second and third feed lines according to another exemplary embodiment of the present invention.

Referring now to FIG. 12, this figure illustrates another alternative exemplary embodiment in which the phase shifter 100 comprises two coupling arms, 200A, 200B of a unitary system that can adjust the phase for second and third feed lines 1600, 1605. In FIG. 12, the first coupling arm 200A is disposed at a position diametrically opposite to the second coupling arm 200B.

Figure 13:
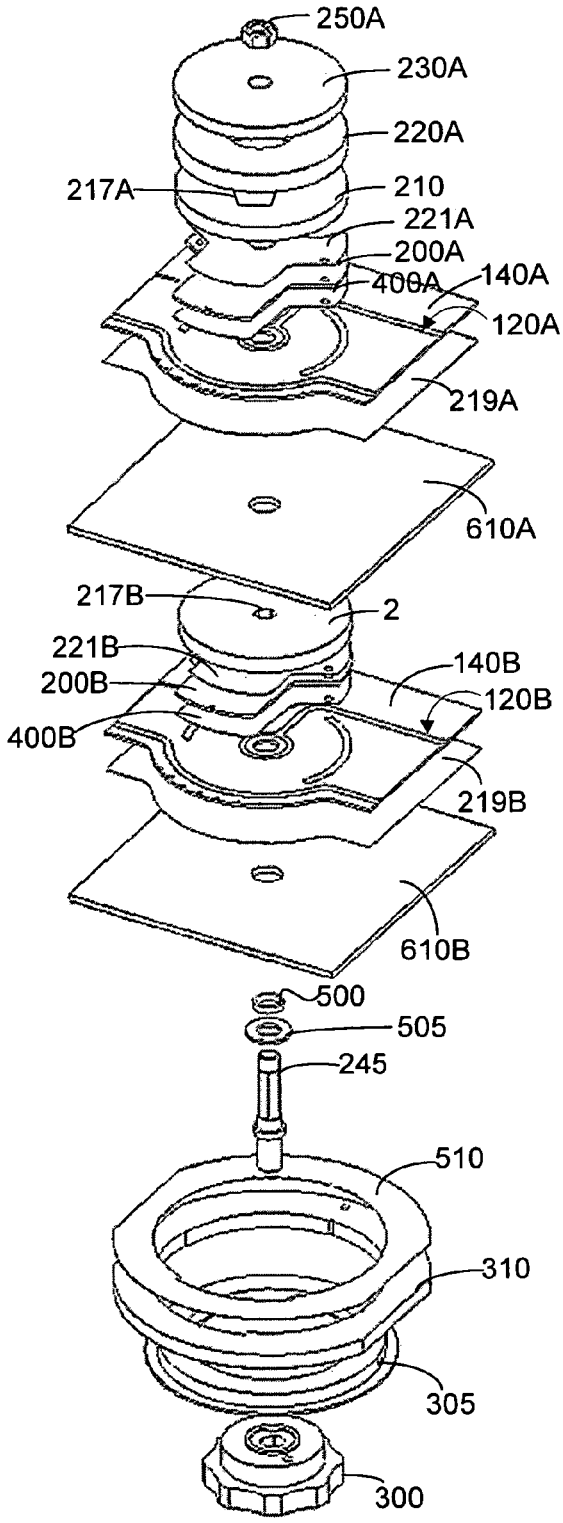
FIG. 13 is an illustration showing an exemplary phase shifter that comprises two separate coupling arms that have separate wiper elements that can adjust phases for feed lines that are positioned in a stacked arrangement according to an alternate exemplary embodiment of the present invention.

Referring now to FIG. 13, this figure illustrates a phase shifter 100 that comprises a first coupling arm 200A and a second coupling arm 200B that are coupled to the same shaft 245 but on different geometrical planes relative to each other. In this way, the first coupling arm 200A can control the phase of RF energy propagating within the first feed lines 120A supported by the planar surface 140A. Similarly, the second coupling arm 200B can control the phase of the RF energy propagating within the second feed lines 120B on the second planar surface 140B.

Figure 14:
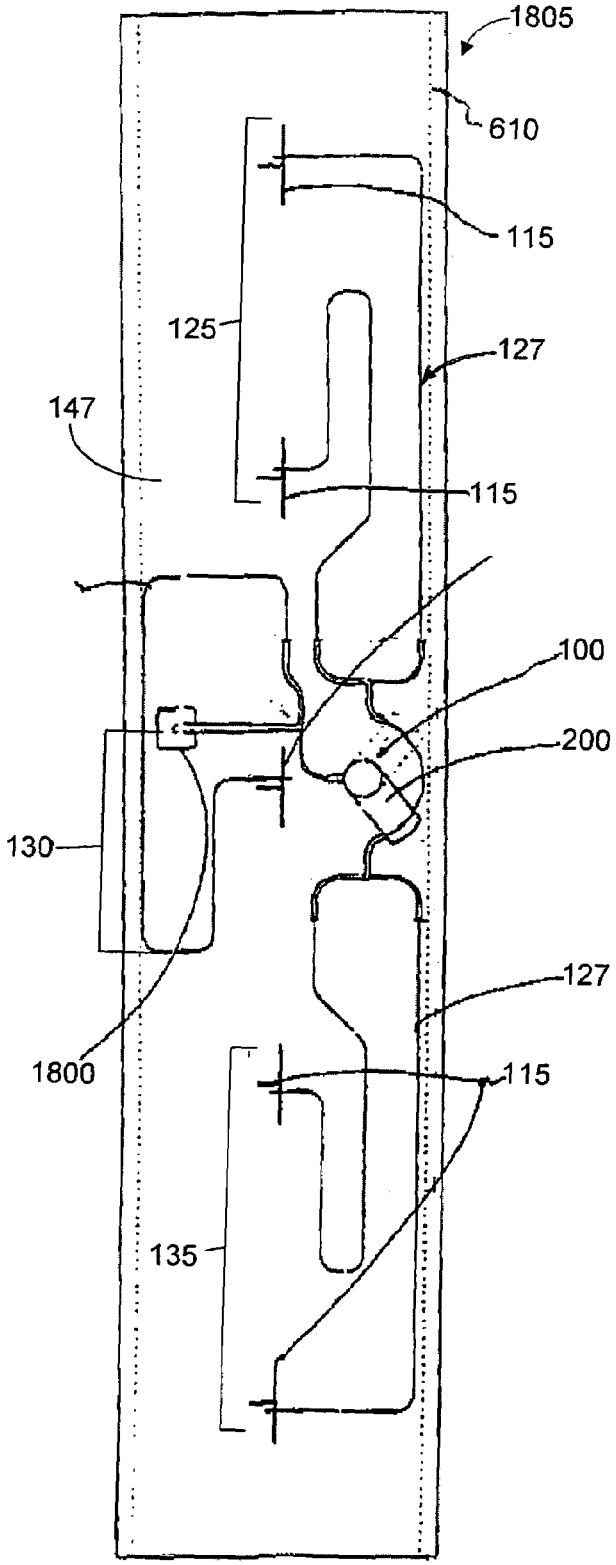
FIG. 14 is an illustration showing an elevational view of an antenna array that is controlled by an exemplary phase shifter according to an exemplary embodiment of the present invention.

Referring now to FIG. 14, this figure illustrates an exemplary phase shifter 100 that can vary the phase between a top antenna group 125 and a bottom antenna group 135. The middle antenna group 130 can be a reference since the middle antenna group 130 is coupled directly to the connector 1800 without any adjustment to its phase. The three antenna groups 125, 130, and 135 can form a variable electrical down tilt antenna 1805 that can be adjusted in a progressive manner by varying the position of the coupling arm 200 of the phase shifter 100 along the range of its movement over a semicircular transmission line segment.

Movement of the coupling arm 200 can result in the simultaneous advancement of a phase angle of a signal to one of the antenna groups coupled to an output feed line. In contrast to the top and bottom antenna groups 125, 135 of the antenna assembly that can be connected to the phase shifter 100 of the present invention, the middle antenna group 130 can be directly coupled to an antenna connector without any interaction or contact with the phase shifter 100. Consequently, the phase angle of the RF signal to the middle antenna group 130 is fixed by the length of that transmission line and provides a reference frame for the phase groupings associated with the remaining antenna groups 125, 135 that are coupled to the phase shifter 100.

While the antenna 1805 illustrated in FIG. 14 has three antenna groups 125, 130, and 135, the present invention is not limited to this number of antenna groups. Fewer or more antenna groups can be provided without departing from the scope and spirit of the present invention. The antenna 1805 of FIG. 14 comprises five radiators 115 in three groups where the centrally located phase shifter 100 is connected to an input power divider and the outputs of the phase shifter are connected to a second level power divider. The three fixed power dividers and the phase shifter 100 are implemented with printed circuit board technology. The advantage of this is a centrally located phase shifter 100 that is implemented in PCB technology that is characterized by its consistency, repeatability and low cost in terms of manufacture for the phase shifter antenna. All signals from the phase shifter 100, and the one signal that avoids the phase shifter, are connected by coaxial cable to the individual radiator elements 115.

Figure 15:
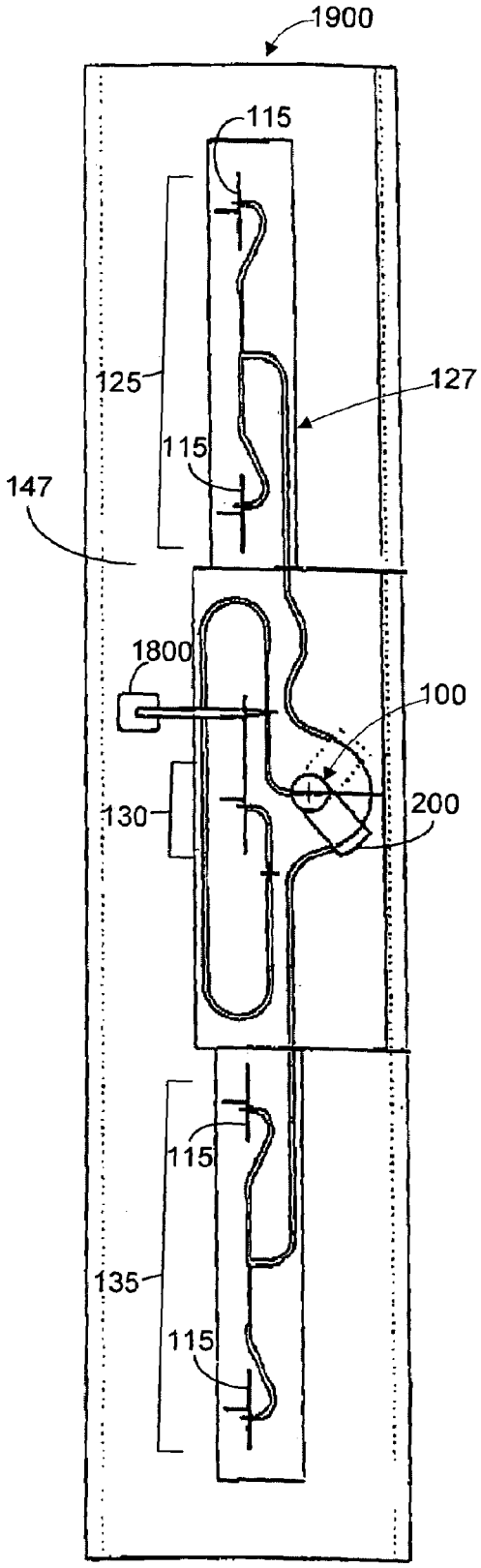
FIG. 15 is an illustration showing another antenna array that is controlled by another phase shifter according to an alternative exemplary embodiment of the present invention.

An alternate embodiment shown in FIG. 15 shows basically the same structure as described above for FIG. 14. A difference is that the antenna of FIG. 15 uses a distributed power divider and all signals connect to the radiators through microstrip transmission lines implemented with PCB technology (and do not use coaxial cable).

Where trade-offs have to be considered between cost and performance, microstrip offers the advantage where the whole distribution network can be manufactured with one component board (although three boards are shown in FIG. 15), leading to uniformity and tolerance precision in manufacturing, consistency and speed for high volume manufacturing, reduction in the number of interconnects and greater repeatable performance specifications. The trade off for these benefits is generally a higher materials cost.

It is to be noted that the phase shifter 100 of this invention uses this microstrip technology and therefore brings to its user all the advantages as described above. In terms of manufacturing, this means that one sheet of PCB with the dies for the network feed board and the two current carrying components of the phase shifter 100 can be put through etching process in one step and output a single integrated component that comprises all of the power distribution functionality and the phase shifting functionality.

Figure 16:
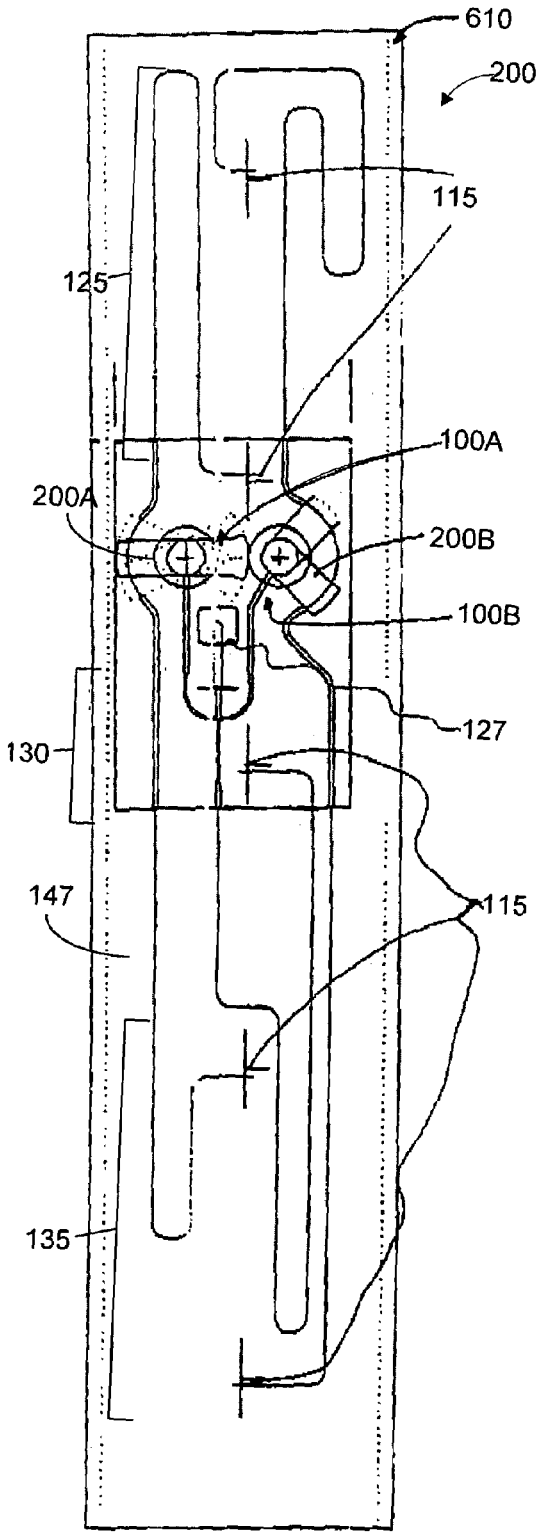
FIG. 16 is an illustration showing an antenna array that is controlled by two exemplary phase shifters according to an alternative exemplary embodiment of the present invention.

Referring now to FIG. 16, this figure illustrates another alternative exemplary antenna array 2000 that comprises a phase shifter 100A, 100B having a first coupling arm 200A and a second coupling arm 200B. In this particular exemplary embodiment, the first coupling arm 200A can work in tandem with the second coupling arm 200B.

Figure 17:
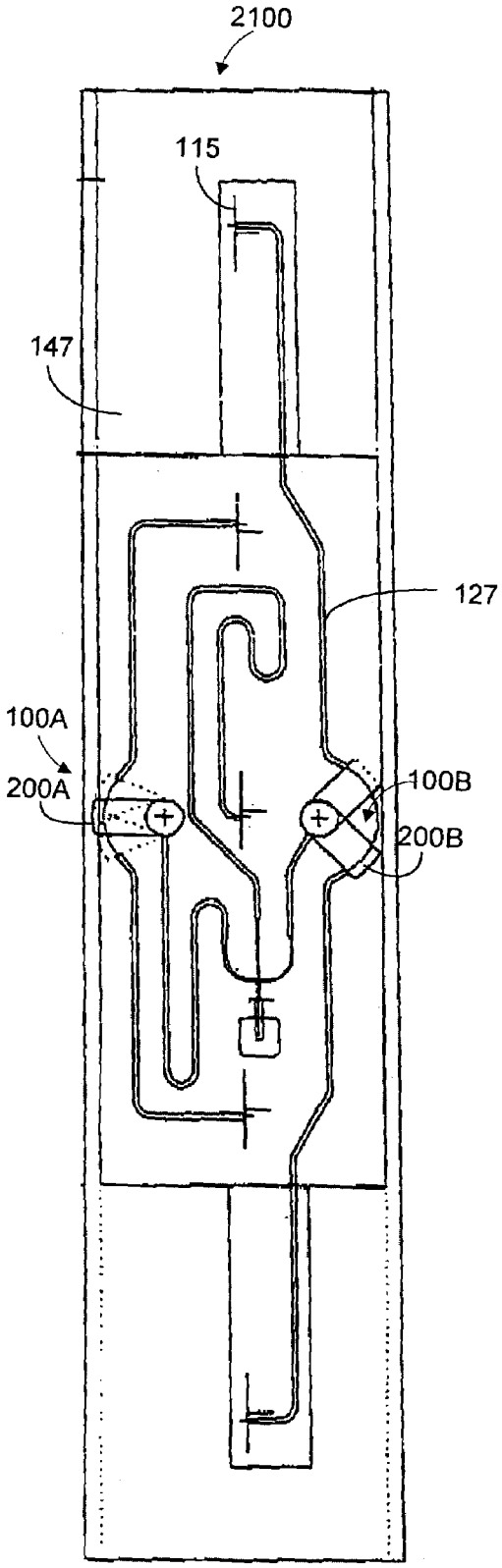
FIG. 17 is an illustration showing another antenna array controlled by two phase shifters according to another alternative exemplary embodiment for the present invention.

Referring now to FIG. 17, this figure illustrates another alternative exemplary embodiment of an antenna array 2100 that comprises two phase shifters 100A, 100B having a first coupling arm 200A and the second coupling arm 200B. The first coupling arm 200A works or moves independently of the second coupling arm 200B, and vice versa.

Figures 18, 19, 20:
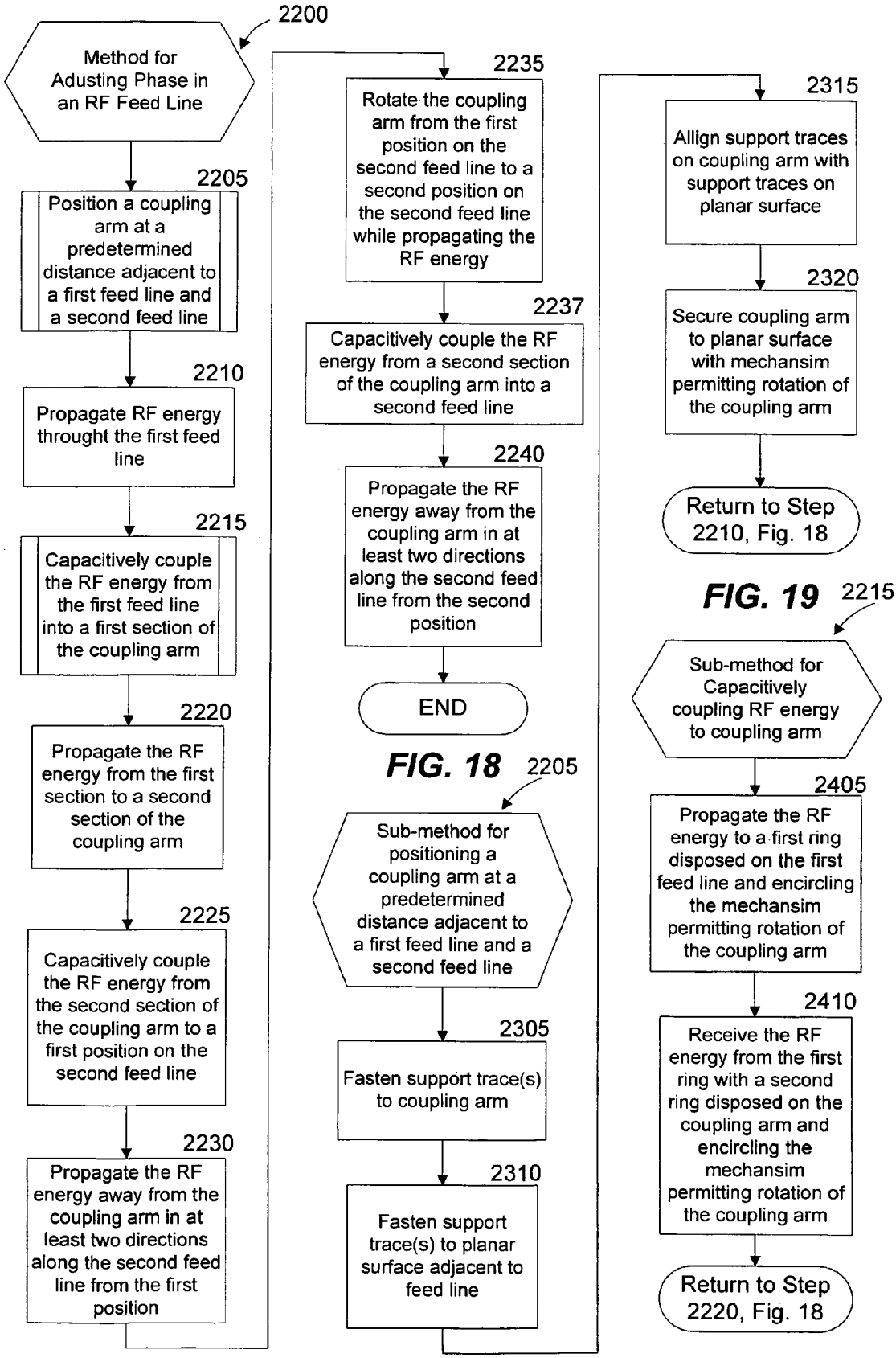
FIG. 18 is an exemplary logical flow diagram describing a method for adjusting phase in an RF feed line according one exemplary embodiment of the present invention.
FIG. 19 is a logical flow diagram illustrating an exemplary sub-method for positioning a coupling arm at a predetermined distance adjacent to a first feed line and second feed line as described in FIG. 18.
FIG. 20 is another logical flow diagram illustrating an exemplary sub-method for capacitively coupling RF energy to a coupling arm as described in FIG. 18.

Referring now to FIG. 18, this figure illustrates a logic flow diagram 2200 for a method of adjusting phase in a RF feed line. Basically, the logic flow diagram 2200 highlights some key functions of the phase shifter 100 described above.

Certain steps in the process described below must naturally precede others for the present invention to function as described. However, the present invention is not limited to the order of the steps described if such order or sequence does not alter the functionality of the present invention. That is, it is recognized that some steps may be performed before or after other Steps without departing from the scope and spirit of the present invention.

Like an antenna, the phase shifter 100 described herein is a passive reciprocal device. Its operation is identical at any particular frequency. Its performance characteristics are independent of the primary direction of energy flow. The phase shifter is, therefore, equally effective for use in a variable electrical downtilt antenna for both transmitting and receiving signals.

Routine 2205 is the first routine in the exemplary method 2200 for adjusting phase in an RF feed line. In routine 2205, the coupling arm 200 is positioned at a predetermined distance adjacent to a first feed line 1105 and a second feed line 1110. Further details of routine 2205 will be discussed below with respect to FIG. 19.

In Step 2210, RF energy is propagated through the first feed line 1105. Next, in routine 2215, the RF energy propagating through the first feed line 1105 is capacitively coupled into a first section of the coupling arm 200. Further details of routine 2215 will be discussed below with respect to FIG. 20.

In Step 2220, the RF energy is propagated from the first section to a second section of the coupling arm 200. Next, in Step 2225, the RF energy is capacitively coupled from the second section of the coupling arm 200 (that typically comprises the wiper element 1005) to a first portion 1125 on the second feed line 1110. The RF energy is then propagated away from the coupling arm 200 in at least two directions along the second feed line 1110 relative to the first portion 1125.

In Step 2235, the coupling arm 200 is rotated from the first portion 1125 on the second feed line 1110 to a second portion 1130 of the second feed line 1110 while propagating the RF Energy. In step 2237, RF energy is capacitively coupled from the wiper element 1005 into a portion of a second feed line 1110. In Step 2240, the RF energy is propagated away from the coupling arm 200 in at least two directions along the second feed line 1110 from the second position or portion 1130. The process then ends.

Referring now to FIG. 19, this figure illustrates an exemplary submethod 2205 for positioning a coupling arm 200 at a predetermined distance adjacent to a first feed line 120A and a second feed line 120B. Step 2305 is the first step in the submethod in which a support trace 405A is fastened to the coupling arm 200. Next, in Step 2310, another support trace 405B is fastened to a planar surface 140 adjacent to the first feed line 120A.

In Step 2315, the support traces 405A on the coupling arm 200 are aligned with the support traces 405B on the planar surface 140. Next, the coupling arm 200 is secured to the planar surface with a mechanism that permits rotation of the coupling arm 200. The mechanism permitting rotation of the coupling arm 200 can comprise the support architecture 240 in addition to the washer 230, spring 220, key 210, and dielectric spacer 400. In Step 2325, the process returns to Step 2210 of FIG. 18.

Referring now to FIG. 20, this figure illustrates an exemplary submethod 2215 for capacitively coupling RF energy to the coupling arm 200. Step 2405 is the first step in the process in which the RF energy is propagated to a first ring 1100 disposed on the first feed line 1105 and in circling the mechanism permitting rotation of the coupling arm 200. Next, in Step 2410 the RF energy is received from the first ring 1100 with a second ring 1000 disposed on the coupling arm 200 and encircling the mechanism permitting rotation of the coupling arm 200. In Step 2415, the process returns to Step 2220 of FIG. 18.

Figure 21:
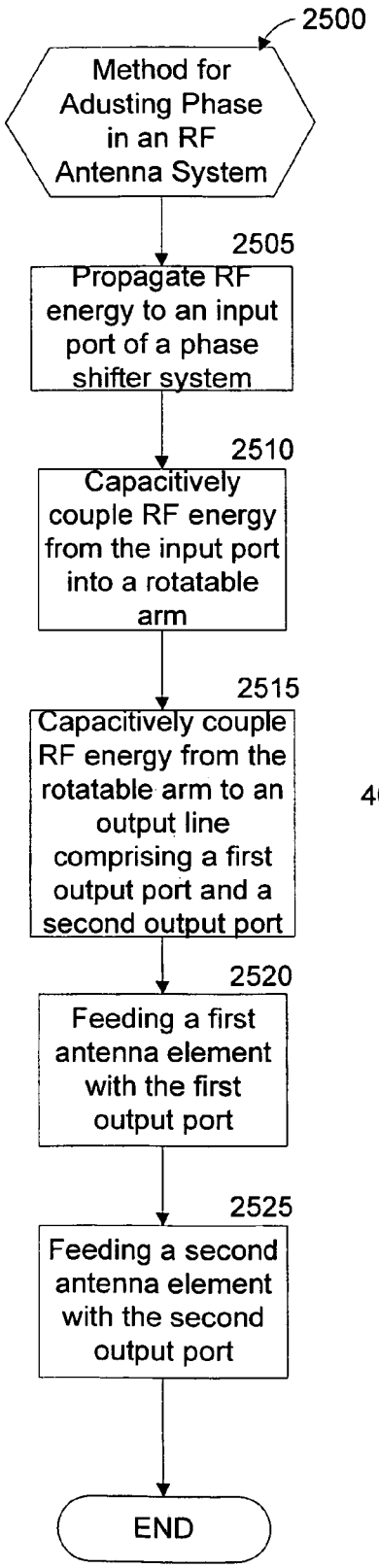
FIG. 21 is an exemplary logical flow diagram describing a method for adjusting phase in an RF antenna system according one exemplary embodiment of the present invention.

Referring now to FIG. 21, this figure illustrates an exemplary method 2500 for adjusting phase in an RF antenna system. Step 2505 is the first step in the method in which RF energy is propagated to an input port comprising a first coupling ring 1100 of a phase shifter. Next, in Step 2510, the RF energy is capacitively coupled from the input port comprising the first coupling ring 1100 into a second coupling ring 1000 of a rotatable coupling arm 200. In step 2515, the RF energy is capacitively coupled from a wiper element 1005 of the coupling arm 200 into an output feed line 120B comprising a first output port and second output port.

In Step 2520, an first antenna element 115 of a first antenna group is fed with the RF energy of the first output port. Next, in Step 2525, a second antenna element 115 is fed with the second output port. The RF energy of the first output port has a different electrical phase relative to the RF energy of the second output port because of the relative lengths of the feed lines for the respective output ports are different. The feed line lengths are different because of the position of the coupling arm 200 relative to the output feed line 120B.

While the present invention describes how the coupling arm 200 capacitively couples RF energy from one feed line to another feed line, the present invention is not limited to this form of coupling. Other forms of coupling can include, but are not limited to, inductive type coupling, or a combination of inductive and capacitive coupling, and other like reactive or passive coupling techniques.

In order to adjust the amount of phase produced by an exemplary phase shifter 100 of the present invention, several parameters of the phase shifter 100 can be adjusted. For example, the size of the feed line traces can be changed to adjust phase of the electrical RF energy propagating therethrough. Similarly, the radius of the coupling arm 200 can be increased or decreased to adjust the relative phasing of a feed line. And further, substrates having higher or lower dielectric constant can be employed to adjust the relative phase of the feed lines interacting with the phase shifter 100.

The method and system of the present invention produces phase shifts in RF feed lines that can support high power and multi-carrier RF applications. Further, the method and system produces phase shifts in RF feed lines that yield a relatively low return loss and power loss. The invention also produces phase shifts that can reduce Passive Intermodulation (PIM) by employing non-contacting metal structures that can be easily assembled in high volume manufacturing environments.

Additionally, the method and system according to the present invention produces phase shifts in RF Feed Lines with sliding-contacts that are not sensitive to wear or corrosion. The phase shifter and method of the present invention also yields low return losses while supporting large RF Bandwidths. With the present method and system, linear phase shifts are produced even at high power levels. The phase shifter and method are highly reliable and consistent over numerous cycles. The inventive system can be manufactured with minimal re-tooling in production plants and at a reduced cost.

What is claimed is:

1. A dual wiper element phase shifter comprising:

a first coupling arm for effecting variable electrical phase shift between outputs of a first RF feed line, a first wiper element, a first coupling ring for capacitively coupling the first coupling arm to an input of the RF feed line, and a first mid portion connecting the first coupling ring to the first wiper element, the first coupling arm being rotatable about a first axis centered relative to the first coupling ring;

a second coupling arm for effecting variable electrical phase shift between outputs of a second RF feed line, a second wiper element, a second coupling ring for capacitively coupling the second coupling arm to an input of the second RF feed line, and a second mid portion connecting the second coupling ring to the second wiper element, the second coupling arm being rotatable about a second axis centered relative to the second coupling ring; and a single-mesh geared mechanical linkage coordinating rotation of the first and second coupling arms to provide coordinated electrical phase shift to RF signals propagating on the first and second RF feed lines.

2. The phase shifter of claim 1, further comprising at least two capacitive junctions formed between the first coupling arm and the first RF feed line, and at least two capacitive junctions formed between the second coupling arm and the second RF feed line.

3. The phase shifter of claim 2, wherein a first capacitive junction formed between the first coupling arm and the first RF feed line comprises the first coupling ring and the first RF feed line, and a second capacitive junction formed between the first coupling arm and the first RF feed line comprises the first wiper element and the first RF feed line.

4. The phase shifter of claim 3, wherein a first capacitive junction formed between the second coupling arm and the second RF feed line comprises the second coupling ring and the first RF feed line, and a second capacitive junction formed between the second coupling arm and the second RF feed line comprises the second wiper element and the second RF feed line.

5. The phase shifter of claim 4, wherein the mechanical linkage comprises a first gear carried on a common shaft with the first coupling arm intermeshed with a second gear carried on a common shaft with the second coupling arm.

6. The phase shifter of claim 1, wherein each phase shifter further system further comprises a dielectric spacer positioned adjacent to the coupling arm.

7. The phase shifter of claim 1, wherein each coupling arm comprises an electrical length of approximately one quality of an operating RF wavelength.

8. The phase shifter of claim 1, wherein each coupling arm comprises an electrical length of approximately a multiple of one quarter of an operating RF wavelength.

9. The phase shifter of claim 1, wherein each wiper element transfers RF energy to its associated RF feed line through a capacitive junction.

10. The phase shifter of claim 1, wherein each RF feed line comprises a shape that corresponds with a shape of its associated wiper element, the wiper element moving within a volume that is positioned adjacent to the RF feed line when the coupling arm is rotated.

11. The phase shifter of claim 1, further comprising a first spring for pressing the first coupling arm against a planar surface, and a second spring for pressing the second coupling arm against the planar surface.

12. The phase shifter of claim 1, wherein each coupling arm further comprises an aperture and the phase shifter further comprises a shaft positioned within each aperture, each coupling arm being rotatable about its associated shaft.

13. The phase shifter of claim 1, wherein the first coupling arm further comprises a dielectric support comprising a wing portion and an arm portion, the arm portion supporting the first wiper element.

14. The phase shifter of claim 1, wherein the first coupling arm further comprises a support trace for balancing circular movement of the first coupling arm.

15. The phase shifter of claim 1, further comprising a support trace positioned on a planar surface separate from the first coupling arm, for balancing circular movement of the first coupling arm.

16. The phase shifter of claim 1, further comprising a support architecture for maintaining a constant spacing between die coupling arm and a feed line while providing for balanced circular movement of the first coupling arm through a volume positioned adjacent to the first RF feed line.

17. The phase shifter of claim 16, wherein the support architecture further comprises:

a shalt; and a washer.

18. The phase shifter of claim 16, wherein the support architecture comprises:

a spring for providing a compressive force against the coupling arm; and a key for connecting die coupling arm to a shaft.

19. The phase shifter of claim 1, further comprising a knob for rotating the first or second coupling arm.

20. The phase shifter of claim 1, further comprising an automated adjustment mechanism for rotating the first or second coupling arm.

21. The phase shifter of claim 20, wherein the automated adjustment mechanism comprises a motor.

22. The phase shifter of claim 20, wherein the automated adjustment mechanism is remotely activated with a remote controller.

23. An antenna system comprising:

a first antenna element;

a second antenna element;

a first wiper element phase shifter for effecting variable electrical phase shift on a first RF feed line connected to the first antenna element;

a second wiper element phase shifter for effecting variable electrical phase shift on a second RF feed line connected to the second antenna element; and a single-mesh geared mechanical linkage coordinating rotation of the first and second wiper element phase shifters to provide coordinated electrical phase shift to the first and second antenna elements in response to rotation of the first and second coupling arms.

24. The antenna system of claim 23, wherein the first wiper element phase shifter comprises a first coupling arm linked to the first RF feed line by at least two capacitive junctions; and the second wiper element phase shifter comprises a second coupling arm linked to the second RF feed line by at least two capacitive junctions.

25. The antenna system of claim 23, wherein the mechanical linkage comprises a first gear associated with the first wiper element phase shifter intermeshed with a second gear associated with the second wiper element phase shifter.

26. The antenna system of claim 24, wherein a first capacitive junction formed between the first coupling arm and the first RF feed line comprises a first coupling ring and a second capacitive junction formed between the first coupling arm and the first RF feed line comprises a first wiper element.

27. The antenna system of claim 26, wherein a first capacitive junction formed between the second coupling arm and the second RF feed line comprises a second coupling ring and a second capacitive junction formed between the first coupling arm and the first RF feed line comprises a second wiper element.

28. The antenna system of claim 23, wherein the first wiper element phase shifter comprises a first dielectric spacer and the second wiper element phase shifter comprises a second dielectric spacer.

29. A method for effecting coordinated electrical phase shift in multi-element antena, comprising the steps of:

providing a first wiper element phase shifter for effecting variable electrical phase shift on a first RF feed line connected to a first antenna element;

providing a second wiper element phase shifter for effecting variable electrical phase shift on a second RF feed line connected to a second antenna element;

providing a single-mesh geared mechanical linkage coordinating rotation of the first and second wiper element phase shifters;

propagating RF signals through the first and second RF feed lines to the first and second antenna elements;

rotating the first and second wiper elements phase shifters as coordinated by the mechanical linkage to effect coordinated electrical phase shift in the RF signals delivered to the first and second antenna elements.

30. The method of claim 29, further comprising the steps of:

providing the first wiper element phase shifter with a first coupling arm linked to the first RF feed line by at least two capacitive junctions; and providing the second wiper element phase shifter with a second coupling arm linked to the second RF feed line by at least two capacitive junctions.

31. The method of claim 29, wherein the step providing the first wiper element phase shifter with a first coupling arm linked to the first RF feed line by at least two capacitive junctions further comprises the steps of:

fastening a first support trace to the first coupling arm;

fastening the first support trace to a planar surface adjacent to the first RF feed line;

aligning the first support trace on the first coupling arm with the first support trace on the planar surface; and securing the first coupling arm to the planar surface with a mechanism permitting rotation of the first coupling arm.

32. The method of claim 31, wherein the step providing the second wiper element phase shifter with a second coupling arm linked to the second RF feed line by at least two capacitive junctions further comprises the steps of:

fastening a second support trace to the second coupling arm;

fastening the second support trace to the planar surface adjacent to the second RF feed line;

aligning the second support trace on the second coupling arm with the second support trace on the planar surface; and securing the second coupling arm to the planar surface with a mechanism permitting rotation of the second coupling arm.

* * * * *